US006290587B1

(12) United States Patent
McCracken et al.

(10) Patent No.: US 6,290,587 B1
(45) Date of Patent: Sep. 18, 2001

(54) ELECTRICALLY-POWERED POLISHER

(75) Inventors: Robert E. McCracken, Tampa, FL (US); Raul Cortes, Bolingbrook, IL (US)

(73) Assignee: Wilton Tool Company, LLC, Palatine, IL (US)

( * ) Notice: Subject to any disclaimer, the term of this patent is extended or adjusted under 35 U.S.C. 154(b) by 0 days.

(21) Appl. No.: 09/027,314

(22) Filed: Feb. 20, 1998

Related U.S. Application Data

(63) Continuation-in-part of application No. 08/743,589, filed on Nov. 4, 1996, now Pat. No. 5,830,047, which is a continuation of application No. 08/546,272, filed on Oct. 20, 1995, now Pat. No. 5,595,532.

(51) Int. Cl.[7] ..... B24B 23/00
(52) U.S. Cl. ..... 451/357; 451/294
(58) Field of Search ..... 451/357, 294; 200/61.85, 16 R, 16 D, 16 C, 553, 547–551

(56) References Cited

U.S. PATENT DOCUMENTS

| | | | |
|---|---|---|---|
| D. 161,484 | 1/1951 | McQuown | 451/357 |
| D. 221,129 | 7/1971 | Hutchins | D8/2 |
| D. 252,731 | 8/1979 | Parise | D8/62 |
| D. 270,515 | 9/1983 | Dunlap | D8/67 |
| D. 273,079 | 3/1984 | Ibaraki | D8/62 |
| D. 277,638 | 2/1985 | Somers | D8/62 |
| D. 283,590 | 4/1986 | Ibaraki . | |
| D. 295,253 | 4/1988 | Ashworth . | |
| D. 312,714 | 12/1990 | Simonelli . | |
| D. 313,094 | 12/1990 | Itaya . | |
| D. 323,099 | 1/1992 | Sakamoto et al. | D8/61 |
| D. 332,558 | 1/1993 | Hoshino et al. | D8/62 |
| D. 336,229 | 6/1993 | Bunyea | D8/62 |
| D. 337,499 | 7/1993 | Matsunaga et al. | D8/62 |
| D. 349,789 | 8/1994 | Bunyea | D32/19 |
| D. 391,698 | 3/1998 | McCracken . | |
| 1,259,609 | 3/1918 | Denhard . | |
| 1,868,507 | 7/1932 | Roos | 451/359 |
| 1,882,705 | 10/1932 | Anderson | 451/359 |
| 1,929,662 | 10/1933 | Wappat | 200/157 |
| 2,544,343 | 3/1951 | Miller | 173/322 |
| 2,597,971 | 5/1952 | Burnham | 15/97 |
| 2,759,305 | 8/1956 | Helbig | 51/170 |
| 3,401,416 | 9/1968 | Ziegler | 15/49 |
| 3,737,601 * | 6/1973 | Arthur et al. | 200/76 |
| 3,780,246 | 12/1973 | Beckering et al. | 200/157 |
| 3,793,782 | 2/1974 | Bowling | 51/170 PT |
| 3,873,796 | 3/1975 | Worobec, Jr. | 200/157 |
| 3,900,974 * | 8/1975 | Klebe, Jr. et al. | 451/357 |
| 3,922,510 * | 11/1975 | Arthur | 200/76 |
| 4,122,320 | 10/1978 | Edgell et al. | 200/157 |
| 4,133,971 | 1/1979 | Boyd et al. | 174/46 |
| 4,216,630 | 8/1980 | Smart et al. | 51/170 MT |
| 4,216,631 | 8/1980 | Ryer, II | 451/357 |
| 4,276,459 | 6/1981 | Willett et al. | 200/157 |

(List continued on next page.)

FOREIGN PATENT DOCUMENTS

| | | |
|---|---|---|
| 171092 | 10/1934 | (CH) . |
| 3313704 A1 | 10/1984 | (DE) . |
| 2 224 231 A | 5/1990 | (GB) . |

*Primary Examiner*—Robert A. Rose
(74) *Attorney, Agent, or Firm*—Fitch, Even, Tabin & Flannery

(57) ABSTRACT

A power waxer is provided which includes structure for electrically connecting a power cord thereto while minimizing instances of accidental disconnection therebetween with the structure being located so as to substantially remove the power cord as an impediment to the operation and ability to exert proper control over the waxer during operation thereof. Also, there is provided structure for controlling torque output of a motor of a power waxer to selectively change the torque output for different stages of the waxing process.

14 Claims, 15 Drawing Sheets

U.S. PATENT DOCUMENTS

| | | | |
|---|---|---|---|
| 4,295,240 | 10/1981 | Lex | 15/22 R |
| 4,381,628 | 5/1983 | Dicke | 51/170 MT |
| 4,388,780 | 6/1983 | Rees | 51/128 |
| 4,523,411 | 6/1985 | Freerks | 51/170 MT |
| 4,799,282 | 1/1989 | Fischer | 15/98 |
| 4,858,271 | 8/1989 | Berfield et al. | 15/339 |
| 4,866,804 | 9/1989 | Masbruch et al. | 15/49 R |
| 4,875,879 | 10/1989 | Bunyea et al. | 439/501 |
| 4,962,562 | 10/1990 | Englund et al. | 15/230.16 |
| 5,007,128 | 4/1991 | Englund et al. | 15/230.16 |
| 5,008,574 | 4/1991 | Kitahata | 310/68 D |
| 5,038,523 | 8/1991 | Farber et al. | 51/170 R |
| 5,136,130 | 8/1992 | Daly | 200/318.1 |
| 5,138,735 | 8/1992 | Kusz et al. | 15/97.1 |
| 5,185,964 | 2/1993 | Englund et al. | 51/281 R |
| 5,231,727 | 8/1993 | Armbruster | 15/97.1 |
| 5,243,727 | 9/1993 | Tanka et al. | 15/98 |
| 5,289,605 | 3/1994 | Armbruster | 15/97.1 |
| 5,309,594 | 5/1994 | Thompson | 15/97.1 |
| 5,318,158 | 6/1994 | Seasholtz | 191/12 R |
| 5,330,138 | 7/1994 | Schlessmann | 248/52 |
| 5,347,673 | 9/1994 | Nickels, Jr. | 15/97.1 |
| 5,349,785 | 9/1994 | Nickels, Jr. et al. | 451/357 |
| 5,595,532 | 1/1997 | McCracken . | |
| 5,642,008 | 6/1997 | McCracken et al. . | |
| 5,678,272 | 10/1997 | McCracken et al. . | |
| 5,794,300 | 8/1998 | McCracken et al. . | |

* cited by examiner

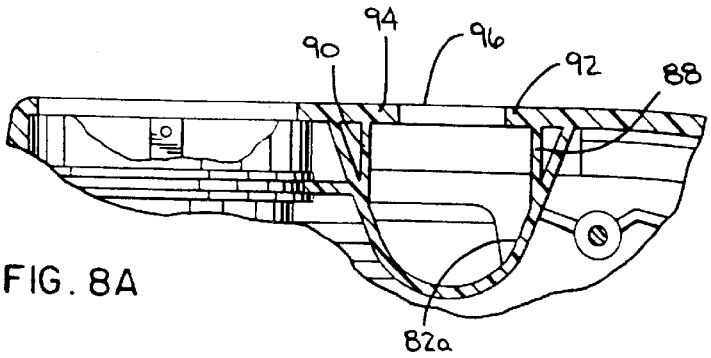
FIG. 8A
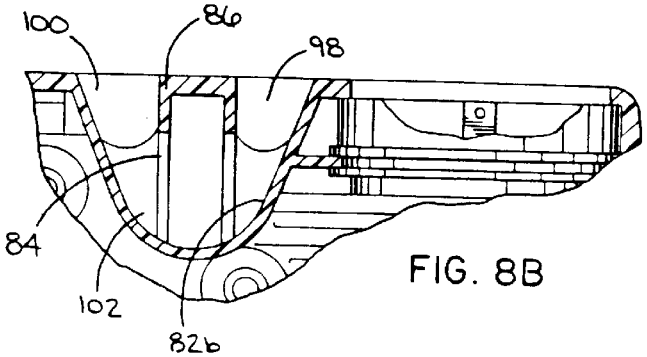
FIG. 8B
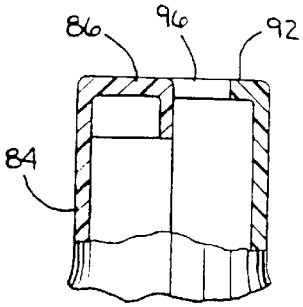
FIG. 9
FIG. 12
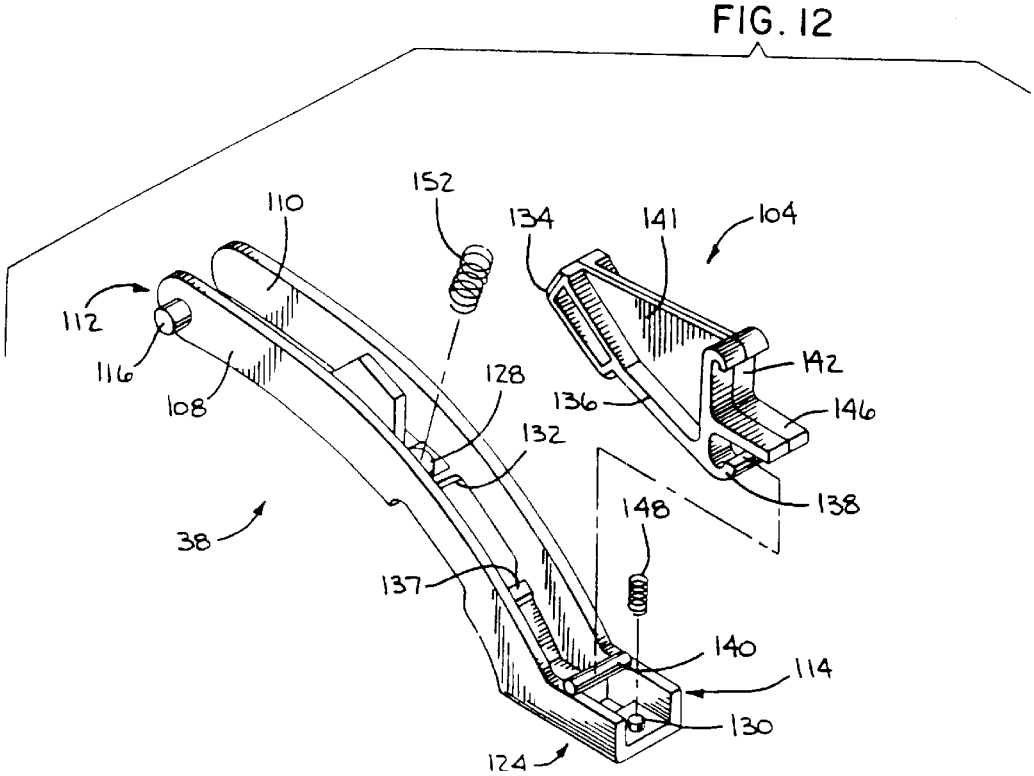

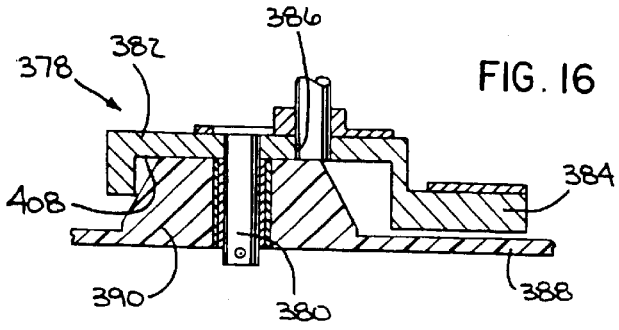
FIG. 16
FIG. 17
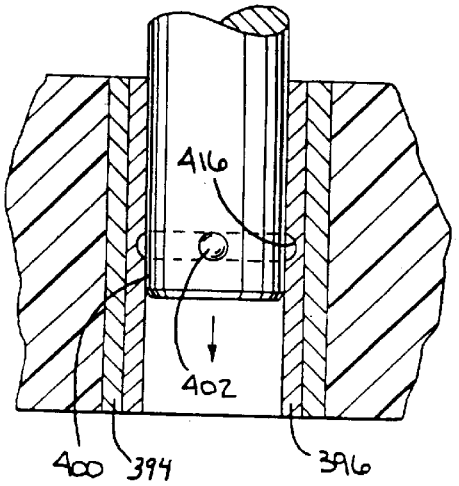
FIG. 18
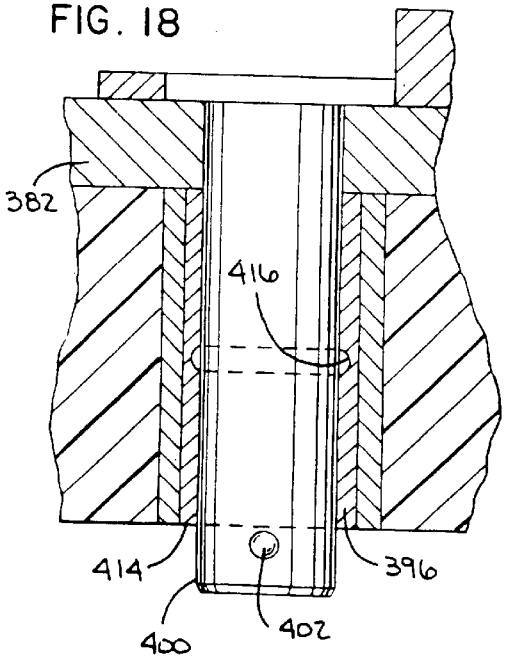
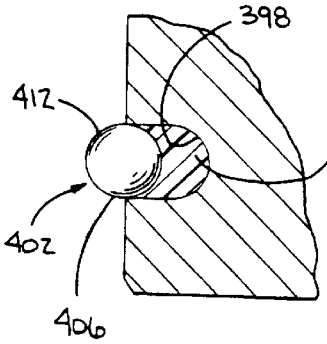
FIG. 19
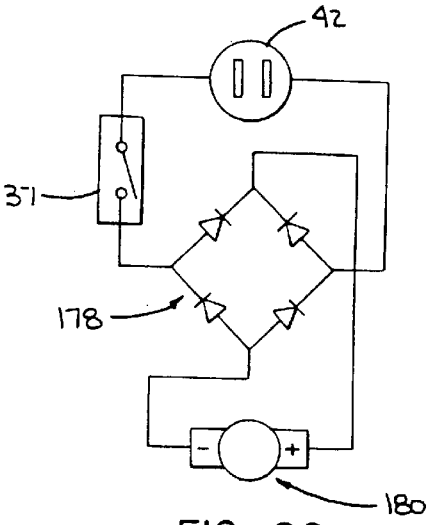
FIG. 22

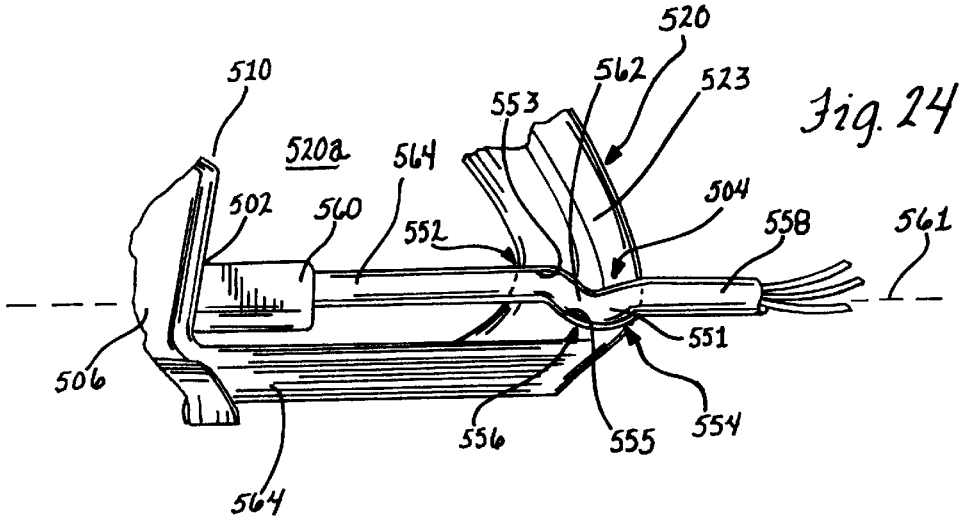
Fig. 24
Fig. 25
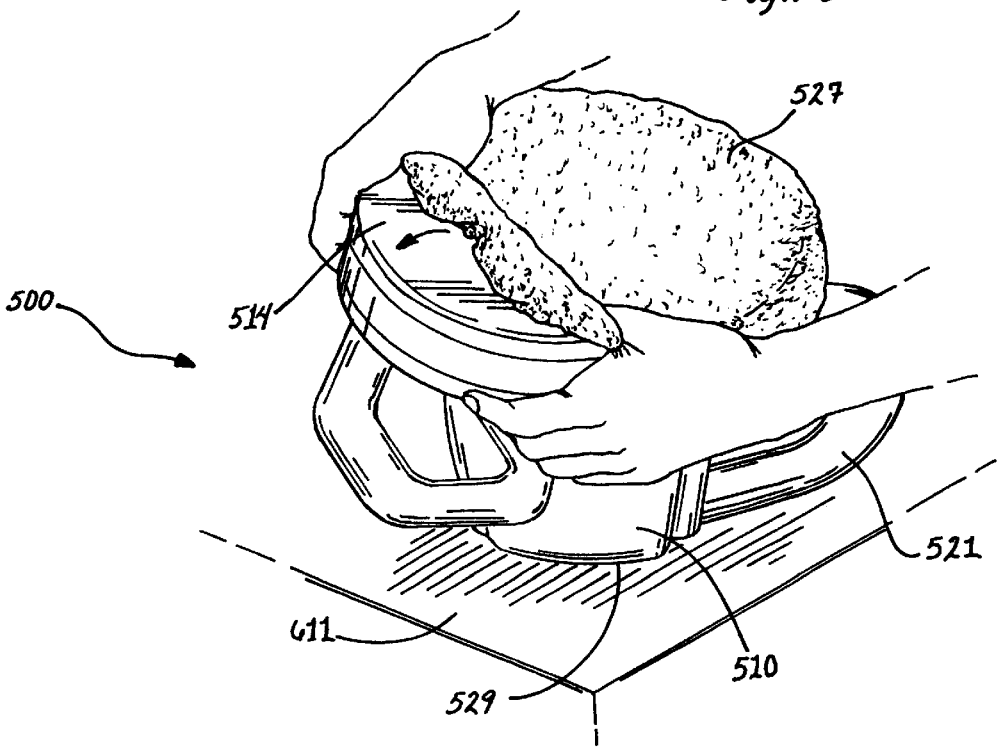

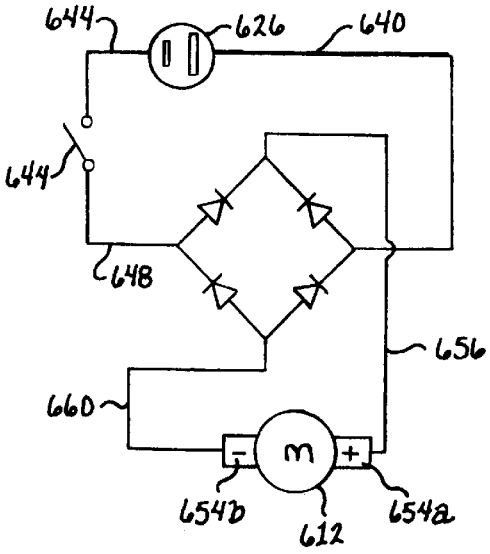
Fig. 27
Fig. 28
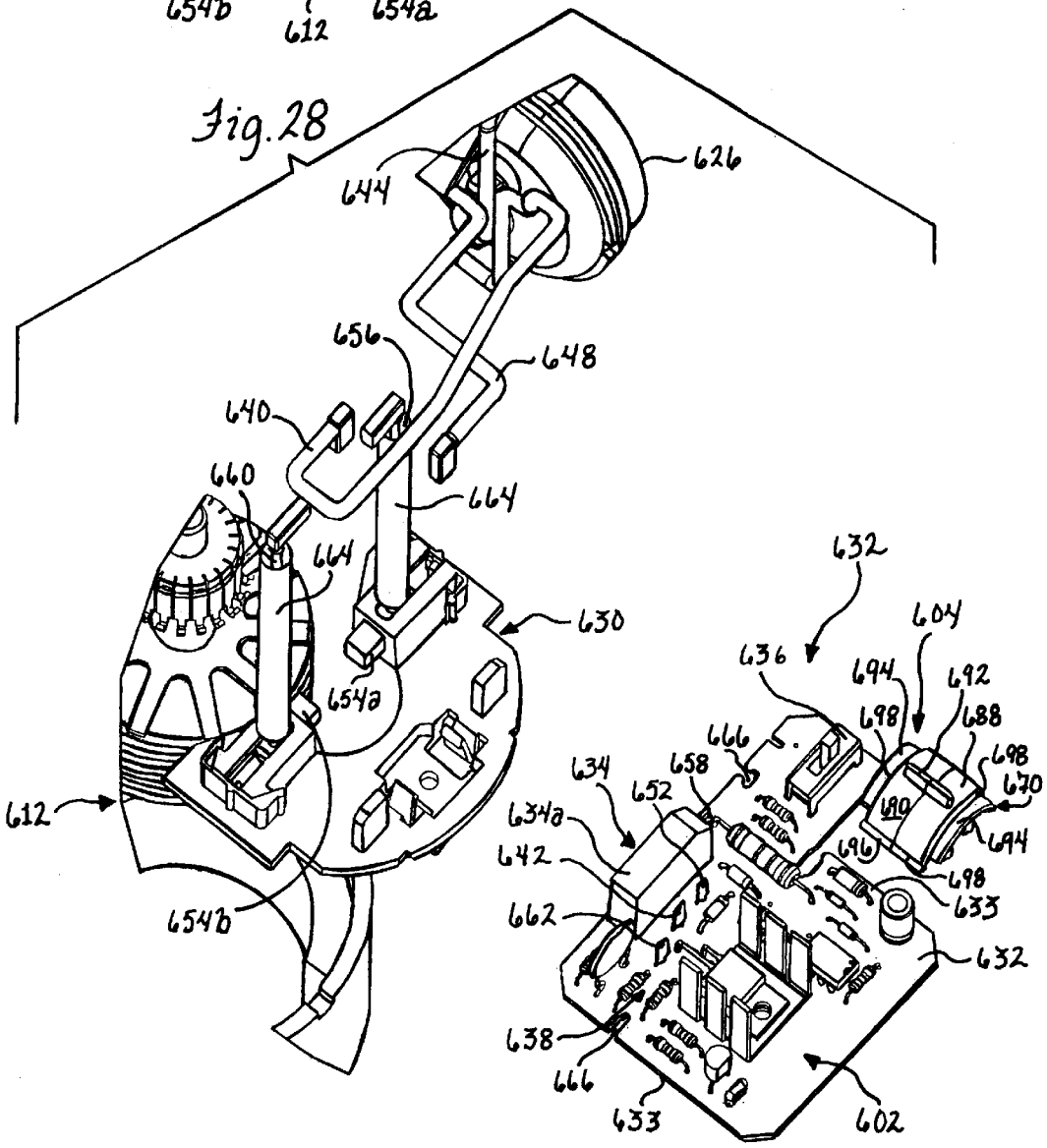

ELECTRICALLY-POWERED POLISHER

RELATED APPLICATION

This application is a continuation-in-part of patent application No. 08/743,589, filed Nov. 4, 1996 now U.S. Pat. No. 5,830,047, which is a continuation of patent application No. 08/546,272, filed Oct. 20, 1995, now issued as U.S. Pat. No. 5,595,532.

FIELD OF THE INVENTION

The present relation relates to power tools and, more particularly, to a power waxer having an electric motor.

BACKGROUND OF THE INVENTION

Typically, power tools, such as polishers or waxers, for use on delicate work surfaces of varying contours, including exterior car finishes, tend to lack a structure, e.g., handles, that allow for effective and precise operator control and maneuverability during operation on the surface. Such power tools commonly include a motor that drives a working element, such as a polishing or waxing pad, in an orbital path for engagement with the work surface. To properly treat the work surface while preventing damage thereto, it is important that an operator be able to precisely guide the working element along the work surface and to simultaneously control the pressure with which the working element is applied to the work surface. For instance, if the tool is used with too much pressure, such as by not being able to control and prevent the entire weight of the tool from being applied to the working element and, consequently, the work surface, the finish on the work surface can be easily damaged or even ruined. On the other hand, too little application pressure will tend to result in the surface finish not being polished properly or in an increase in operation time to accomplish the desired finish.

The vibratory response associated with orbital motion further complicates the polishing operations. It has been found that such response felt by operators using orbital motion is significantly greater than that associated with other non-orbital type tools. Thus, the structure of the power tool must take into consideration this response.

To increase efficiency, it is also desirable that an operator be able cover a relatively large area on the work surface, while at the same time maintaining control over the application pressure and path of the tool during operation. This is usually accomplished by either relocating to a different location relative to the work surface or by extending one's arms over and about the work surface. The latter technique is used most often when polishing remote areas that cannot be accessed by simply relocating, such as when polishing central areas of an automobile, e.g., central areas of the hood, roof and trunk. As mentioned above, experience, however, has taught that accuracy and precision is sacrificed when operating the tool with one's arms extended because of the increased vibrational response from orbital motion.

Another problem in operation of these tools is the location of the power supply line providing power to the motor. Oftentimes, such electrical cord is connected either directly, or with a pigtail cord, to the housing. These power cords tend to increase the likelihood of damage to the working surface due to it and its associated connecting head coming in contact with such surface and any wax thereon during operation of the polisher. This is undesirable due to potential marring of the finish caused by such contact.

Pigtail cords also present the additional problem that when the work surface is close to the ground, such as the lower portions of a car's exterior surface, the mating interface between the heads of the pigtail and the power supplying cord can run along the ground, potentially through any standing water accumulated thereon, which can present a hazardous situation to the operator. If the water causes a ground fault, the power to the tool will be abruptly interrupted, which can cause damage to both the power tool and the surface in engagement with the tool.

Also, normally the cord is in a position relative to the handle such that operators are required to continually adjust their support of the tool and grip on the handle(s) during operation of the tool due to undue interference from the power supplying cord.

With pigtail cords, as well as with cords connected directly to an electrical receptacle on the housing, there exits a concern with accidental separation between the pigtail or the receptacle and the supply cord. Separation problems are compounded with orbital polishers and waxers as typically they are used with car surfaces which can require an operator to move around the automobile to buff or wax the entire extent of its exterior surfaces. Such movement can cause tension to be applied to the interface between the electrical supply cord and the tool, be it on the head of a pigtail cord attached to the housing or at an electrical receptacle at the housing itself. In addition, the increased levels of vibration generated through the polisher housing increases the potential for separation as the cord(s) are constantly experiencing intermittent tension forces.

Thus, there is a need for a power tool, particularly one that drives its working element in an orbital path, which allows an operator to effectively and accurately control the working element and reach a relatively large area on a working surface from a generally stationary position. There is also a need for an ergonomic power tool as described above which removes the electrical connection or power cord as an impediment to control and operation of the tool and substantially limits disconnections at the interface between the power supply and power receiving receptacle of the tool.

Further, with power waxers, the working element typically includes a circular pad that is driven by the electric motor in a somewhat random orbital path so as to simulate the orbital motion made by a person waxing with a rag or cloth by hand. These pads commonly have a foam construction and are not designed to be placed into engagement with the working surface for polishing. Instead, the pad is fitted with a bonnet that is elastically fitted about the pad and is designed for polishing contact with the working surface.

Bonnets of varying material are used for different stages in the polishing process, including wax application, polishing and buffing stages. In a common process, paste or liquid wax is first applied onto an applicator bonnet fitted on the pad for spreading the wax on the work surface. Once the surface is covered with wax, the wax applicator bonnet is removed from the pad and a clean terry cloth bonnet is fitted on the pad for polishing the wax on the work surface. Finally, the surface is buffed to produce a deep shine by placing more pressure on the surface with the pad assembly as the waxer is operated and/or replacing the polishing pad with a bonnet, such as of lambs wool, which creates more friction on the wax surface.

Without being able to quickly change the bonnets, operators would be required to adjust the force applied by the pad assembly on the surface during each stage of the polishing operation. For instance, without changing bonnets, each subsequent stage would require additional pressure, which can lead to mistakes and in many cases damage to the work surfaces. Accordingly, it would be desirable to provide a waxer that allows operators to readily change bonnets to more precisely apply the appropriate force during the various stages during the polishing process.

As discussed in commonly assigned U.S. Pat. No. 5,642,008, power waxers typically use a direct current motor assembly with a rectifier to convert alternating current into direct current for application to the coils of the direct current motor. Another problem lies in the construction of the rectifiers themselves that have elongated blade terminals which extend into and out from the body of the rectifiers. The use of blade terminals adds costs to the manufacture of these rectifiers. Another expense arises with respect to the electrical connections that are necessary between the rectifier and the motor circuitry. Accordingly, a less expensive rectifier for use with a direct current motor for a power tool, and particularly a waxer would be desirable.

SUMMARY OF THE INVENTION

In accordance with the present invention, a power waxer is provided which includes structure for electrically connecting a power cord thereto while minimizing instances of accidental disconnection therebetween with the structure being located so as to substantially remove the power cord as an impediment to the operation and ability to exert proper control over the waxer during operation thereof. Also, there is provided structure for controlling torque output of a motor of a power waxer to selectively change the torque output for different stages of the waxing process.

In one form, the waxer includes a housing for containing a motor. A handle extends away and down from the housing and has an end spaced from the housing. A receptacle mounted on the housing faces toward the handle in alignment with the spaced end for receiving an electrical plug head of a power cord to electrically connect the waxer to an electrical power source for energizing the motor. A cord lock is located on the handle end for capturing a section of power cord to limit unintentional disconnections between the receptacle and plug head and, with the positioning of the receptacle and the cord lock, the handle can be gripped at different locations while operating the waxer without interference from a power cord.

While the first embodiment of the invention hereinafter discussed has an advantageous cord receptacle and lock arrangement on the top of the housing that eliminates the likelihood of the power cord marring the working surface, it can be difficult to rest the waxer upside down on its housing because the plug receptacle and cord lock of the waxer are at the top of the housing. With this arrangement, the operator would have to unplug or remove the power cord from the waxer unit in order to change the bonnet in this manner. By having the cord lock at the distal bottom end of the handle and the plug receptacle on the housing aligned therewith in the above-described form of the waxer, interference from the cord when flipping the housing over to rest it on its top to change bonnets is avoided.

More specifically, the power waxer may also include a pad driven by the motor and a removable cover that fits on the pad for engagement with the working surface. The housing can include a generally flat top so that it may be rested thereon for accessing the pad to replace the cover without interference from a power cord attached in the receptacle and having a section captured in the cord lock.

The cord lock may take the shape of an elongated opening that changes directions at least once so that a section of power cord is bent when placed therein. The elongated opening also may have an arcuate configuration.

The handle may include a lower substantially straight joining portion that extends from the spaced handle end below the cord lock back toward the housing to define a grip opening. The joining portion then is adjacent to and below a cord that is attached in the receptacle with a section thereof captured in the cord lock and extending generally along the joining portion.

The motor also may drive the pad in an orbital path, and the housing may include a front and a rear with the handle being at the rear of the housing and generally extending arcuately in a vertical plane. A second handle may be provided that has a portion spaced forwardly of the housing front and that generally extends arcuately in a horizontal plane. This provides for two-handed control over the waxer with the operator gripping along both arcuate handles at various positions thereon while operating the waxer for maximizing control thereover without interference from a power cord.

The handle may include an actuator for selectively energizing the motor, and the actuator may be spaced from the cord lock along the handle for being engaged by a hand of an operator that is gripping the handle to control the waxer. The handle further may have an arcuate portion to which the actuator is mounted, and the actuator may be in the form of a paddle actuator having an arcuate shape substantially complementary to that of the handle arcuate portion. The actuator may have a lock-on mechanism for keeping the actuator in a position at which the motor is constantly energized without requiring the operator to continually engage the actuator to hold the actuator in the motor energizing position.

In another form, there is provided an orbital waxer having an electrical motor, that is supplied with electrical power by a power cord having a plug on one end, and an upstanding housing for containing the motor. The housing has a central vertical axis extending therethrough and a lower portion and an upper portion with a substantially flat top. An arcuate handle extends away from the housing upper portion and has a distal end spaced from the housing that is at a level generally aligned with the lower portion of the housing. A plug receptacle is located on the lower portion of the housing and has an opening that faces toward the handle end for receiving a cord plug to electrically connect the waxer to an electrical power source for energizing the motor. A pad and bonnet assembly is driven by the motor below the lower portion of the housing in an orbital path for being engaged with a working surface. A cord lock at the handle end captures a section of power cord to limit unintentional disconnections between the receptacle and plug and cooperates with the plug receptacle to maintain a segment of the cord in a substantially fixed position relative to the arcuate handle. This assists in keeping the handle free for gripping along its entire extent above the end during operation of the waxer and in allowing the housing to be turned over and rested on the flat top for changing bonnets on the pad without interference from a power cord.

The arcuate handle also may include a substantially straight joining portion extending from the handle distal end back toward the housing lower portion generally along and below the cord extending in a fixed position between the receptacle and cord lock. The cord fixed position may be substantially perpendicular to the housing central axis.

The handle also may have opposite sides with the cord lock being an elongated channel formed in one of the handle sides. The elongated channel also may have bends which extend in directions that are transverse to the fixed position of the cord.

The arcuate handle may have a predetermined curved shape that extends upwardly from the cord lock of the handle end and then back toward the housing upper portion to provide a variety of different positions over the cord fixed position at which the handle can be gripped for controlling the waxer during operation thereof. An arcuate paddle actuator may be provided for selectively energizing the motor and for being engaged by a hand of an operator that is gripping the handle.

Additionally, the arcuate handle may include a motor output control actuator for selectively changing the torque output of the motor applied to the pad as it is driven in its orbital path and for being engaged by a hand of an operator that is gripping the handle. The actuator also may be a rotary actuator that rotates about an axis that extends transverse to the handle to a plurality of different positions corresponding to different torque outputs of the motor. A linear switch mounted in the motor housing and connected to the rotary actuator is then shifted linearly by rotation of the actuator to different predetermined positions for changing the torque output of the motor.

The pad may have a large diameter of approximately nine and one-half inches.

In another form, there is provided a power waxer having a pad driven by an electric motor and a housing containing the motor with an upper portion and a lower portion with the pad being mounted below the lower portion to be driven by the motor. A handle extends away from the upper portion of the housing generally in a vertical plane, and a rotary switch actuator located adjacent the junction of the housing upper portion and the handle. The rotary actuator having a curved exterior portion that is rotated by a hand of an operator that is gripping the handle. The exterior portion is curved about a transverse axis that is perpendicular to the vertical plane. A linear switch is provided in the housing that slides linearly to a plurality of positions so that when the switch is slid from one position to another position, the motor correspondingly changes from generating one torque output to another torque output. The linear switch is connected to the rotary actuator so that rotation of the actuator curved portion about the axis causes linear sliding of the switch for changing torque outputs of the motor.

The switch also may have first and second positions, and the motor has low and high torque outputs corresponding to the switch first and second positions, respectively. The low torque output is adapted for application of wax by the pad to a work surface, and the high torque output is adapted for polishing and buffing by the pad of the applied wax on the work surface.

The housing also may have a bearing support for the curved portion of the rotary actuator for rotation thereabout. The rotary actuator may include a pair of spaced members in the housing that are rotated along the bearing as the actuator is rotated, and the switch includes a projection between the actuator spaced members for being slid linearly thereby when the actuator is rotated. The switch projection may slide forwardly and rearwardly, and the actuator curved portion is rotatable in forward and rearward rotation directions. When the actuator is rotated in the forward direction, one of the spaced members pushes the projection to slide rearwardly, and when the actuator is rotated in the rearward direction, the other of the spaced members pushes the projection to slide forwardly.

The motor also may drive the pad in an orbital path, and the housing may include a front and a rear with the arcuate handle being at the rear of the housing. There also may be provided a second arcuate handle having a portion spaced forwardly of the housing front and generally extending arcuately in a horizontal plane to provide for two-handed control over the waxer. The operator being able to grip along both arcuate handles at various positions thereon while operating the waxer for maximizing control thereover.

The handle also may include a distal end spaced from the housing that is at a level generally aligned with the housing lower portion. There may be provided a motor actuator for selectively energizing the motor with the motor actuator spaced from the handle distal end for being engaged by a hand of an operator that is gripping the handle to control the waxer. The handle also may include an arcuate portion to which the motor actuator is mounted, and the motor actuator may be in the form of a paddle actuator having an arcuate shape substantially complementary to that of the handle arcuate portion.

The motor actuator may include a lock-on mechanism for keeping the motor actuator in a position at which the motor is constantly energized without requiring that an operator continually engage the motor actuator to hold the actuator in the motor energizing position.

The housing may include a receptacle for receiving a plug on an end of a power cord. The receptacle has an opening facing the handle distal end, and the handle distal end includes a cord lock for capturing a section of power cord to limit accidental disconnections between the receptacle and plug attached therein. The motor may further comprise a direct current motor assembly, and the plug receptacle is for electrically connecting an alternating current power supply to the waxer. There is provided a rectifier to convert the alternating current from the power supply to direct current for the motor assembly. The rectifier has a body in which a plurality of lead pins are mounted to extend exteriorly from the body and to be electrically connected to a printed circuit board.

Further in accordance with the present invention, there is provided a motor output control mechanism for a power tool that has a housing for containing a motor that drives a working element and including a handle extending away from the housing for being gripped to control the tool. A linear switch is mounted in the housing for being shifted in a linear direction to a plurality of predetermined positions for changing the torque output of the motor applied to the working element. A rotary actuator is mounted adjacent the handle and rotatable about an axis for shifting the linear switch between the predetermined positions. There is a connection between the switch and actuator for shifting the switch in the linear direction as the actuator is rotated about the axis to change torque outputs of the motor.

The connection also may include a projection on either of the switch or actuator, and a yoke on the other of the switch and actuator. The projection extends between the yoke so that shifting of either the projection and the yoke causes the other to shift therewith. The projection may be on the switch and the yoke on the actuator. The yoke may include a pair of spaced substantially parallel arms between which the projection extends. The arms rotate about the axis as the actuator is rotated to slide the projection in the linear direction. The switch projection may slide forwardly and rearwardly in response to forward and rearward rotation of the actuator. With the actuator rotated in the forward direction, one of the arms pushes the switch projection to slide rearwardly, and with the actuator rotated in the rearward direction, the other of the arms pushes the switch projection to slide forwardly.

The rotary actuator may include a curved exterior portion accessible to an operator on the housing for rotating the actuator and a curved bearing in the housing on which the curved exterior portion of the actuator is mounted for rotation. The switch also may include a switch projection for sliding linearly, and the rotary actuator may include spaced members below the curved exterior portion for being disposed on either side of the projection in the housing and riding on the curved bearing as the actuator is rotated about the axis so that as the members move in a curved path defined by the curved bearing the projection is slid in the linear direction.

BRIEF DESCRIPTION OF THE DRAWINGS

FIG. 8A is a side sectional view taken along lines 8A—8A of FIG. 7;

FIG. 8B is a side sectional view taken along lines 8B—8B of FIG. 7;

FIG. 9 is a rear sectional view taken along line 9—9 of FIG. 7;

FIG. 12 is an exploded perspective view of the paddle actuator and lock-on button assembly shown in FIG. 16;

FIG. 16 is a side sectional view of the counterweight and buffer pad assembly showing a mounting plate of the pad and a mounting post and detent ball inserted through an axial lining of the buffer pad mounting plate;

FIG. 17 is an enlarged sectional view of the support post and the axial lining shown in FIG. 16 showing a circumferential groove in the axial lining with the detent ball in the groove;

FIG. 18 is an enlarged sectional view of a portion of the apparatus shown in FIG. 17, showing the post inserted through the axial lining with the detent ball abutting the bottom of the lining to removably secure the pad to the post;

FIG. 19 is a side sectional view of the post showing the detent ball attached to a plastic backing which is attached in a recess of the post;

FIG. 22 is an electrical schematic diagram of the DC motor assembly according to the first embodiment of the present invention;

FIG. 24 is a fragmentary elevational of the alternative apparatus of FIG. 23 showing a modified power supply receptacle and cord-locking mechanism;

FIG. 25 is a perspective view of the alternative apparatus of FIG. 23 illustrating an operator installing a bonnet on an operating pad;

FIG. 27 is an electrical schematic diagram of the power circuit of the second alternative apparatus of FIG. 26;

FIG. 28 is a fragmentary exploded perspective view of the alternative apparatus of FIG. 26 showing the brush card, the control panel and rotary actuator.

DETAILED DESCRIPTION OF THE PREFERRED EMBODIMENT

Figure 1:
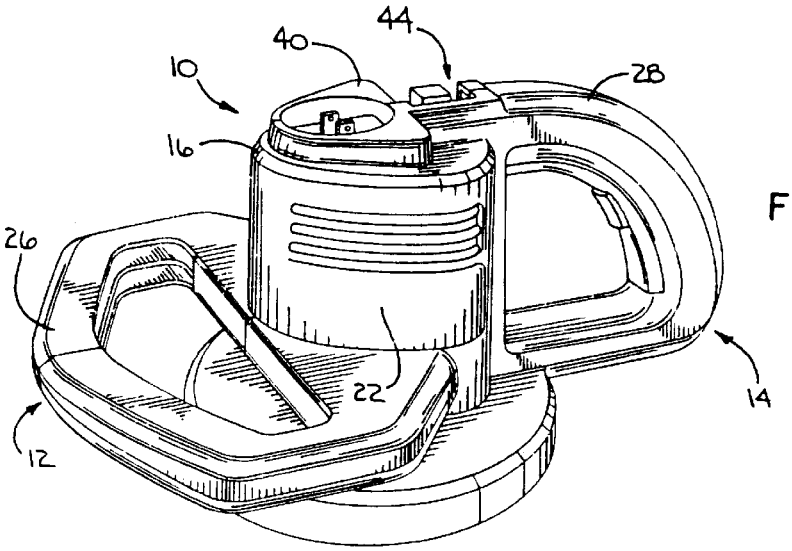
FIG. 1 is a perspective view of an apparatus for waxing, buffing, polishing or the like according to a first embodiment of the present invention.
Figure 2:
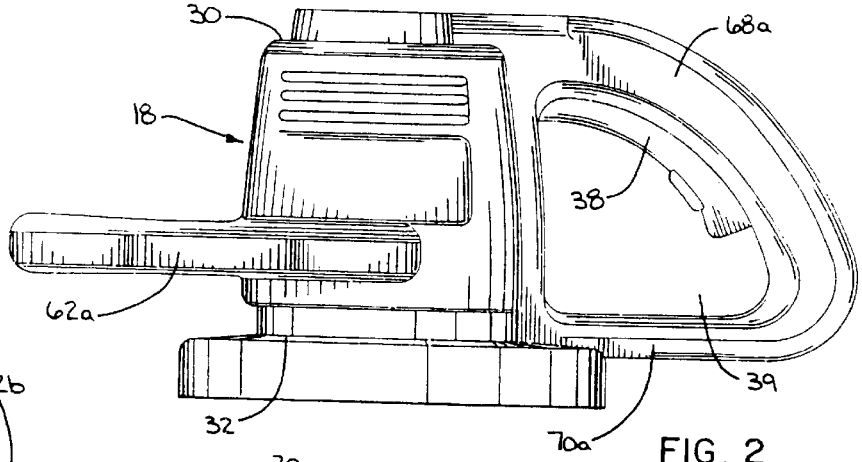
FIG. 2 is a left side elevational view of the apparatus shown in FIG. 1, including a front handle and a rear handle and a paddle actuator on the rear handle.
Figure 3:
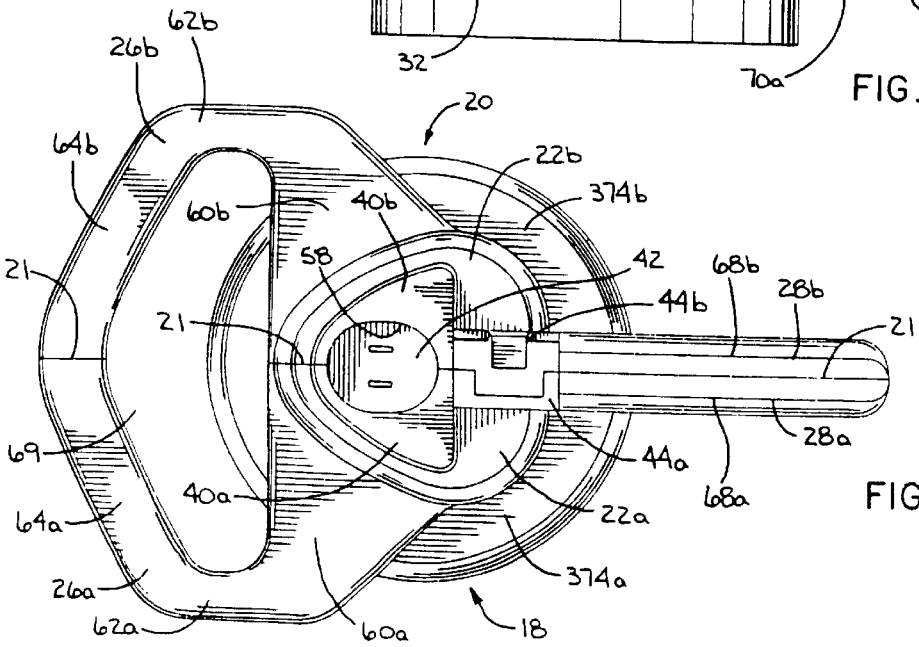
FIG. 3 is a top plan view of the apparatus shown in FIG. 1 showing details of the engagement of a first and a second clamshell housing member which define a cord lock and a collar for a male receptacle.
Figure 4:
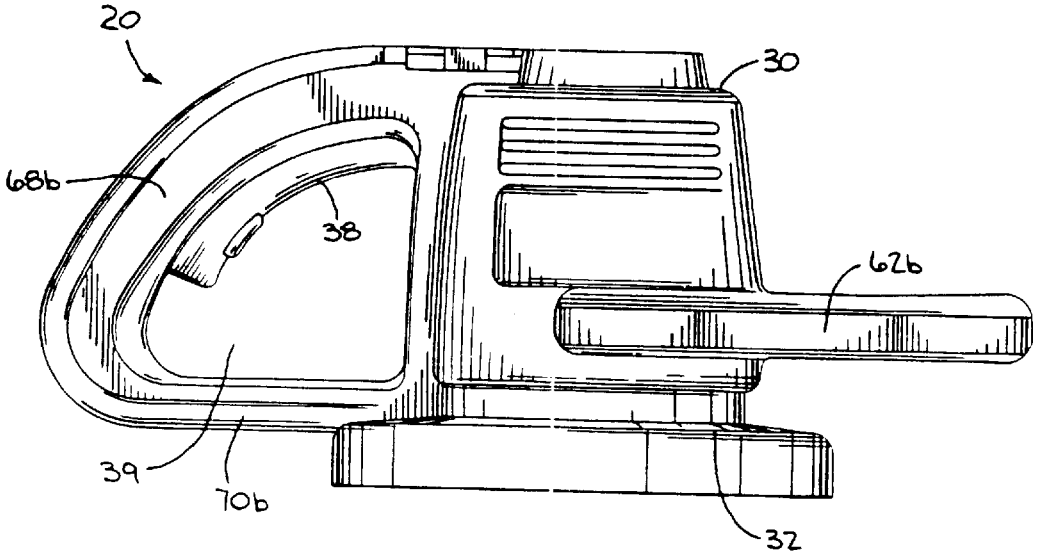
FIG. 4 is a right side elevational view of the apparatus shown in FIG. 1.
Figure 5:
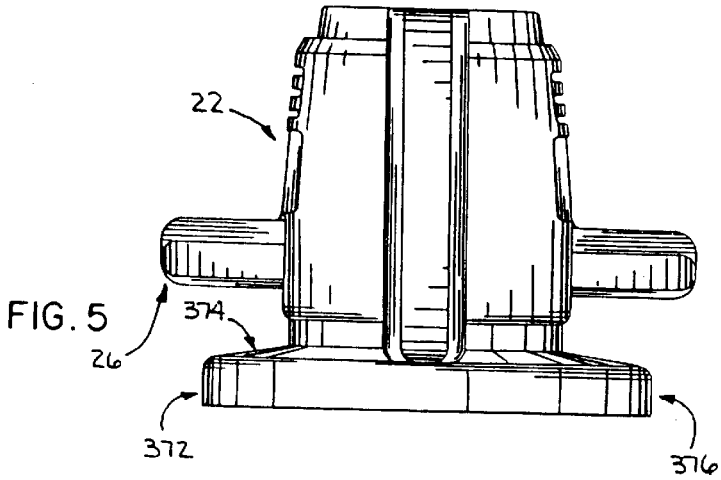
FIG. 5 is a rear elevational view of the apparatus shown in FIG. 1.
Figure 6:
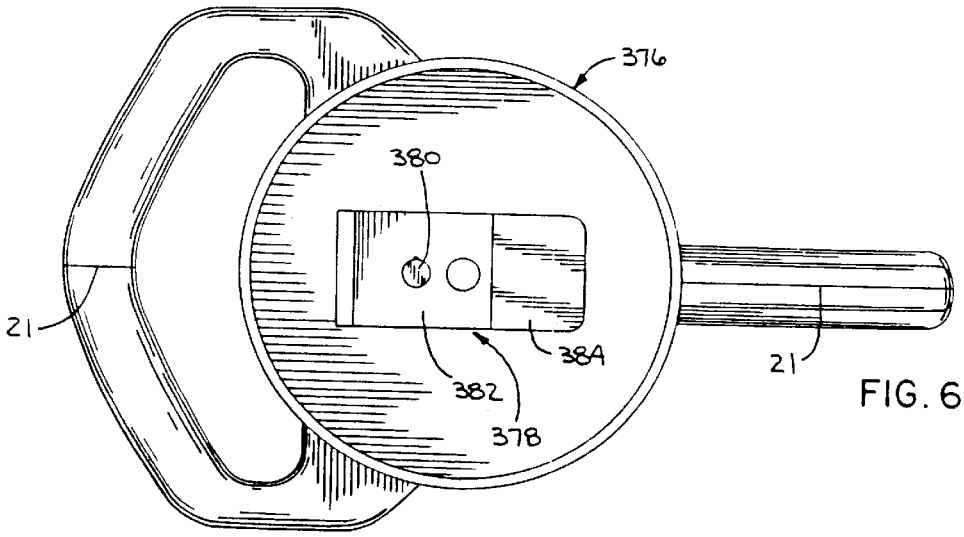
FIG. 6 is a bottom plan view of the apparatus shown in FIG. 1 showing the counterweight assembly including a quick-change post for mounting a buffer pad thereon.

FIG. 1 illustrates an ergonomic apparatus 10 for waxing, polishing, buffing or the like, according to the present invention. The inventive apparatus 10 has a symmetrical design about a vertical reference plane, not shown, extending centrally from a forward end 12 to a rearward end 14. The apparatus 10 includes a housing 16 preferably having a clamshell design with a first clamshell housing member 18 and a second clamshell housing member 20 which, when connected to each other, define a part line 21 which extends in the vertical reference plane about which the housing 16 is symmetrical, as shown in FIG. 3. Preferably, the first and second clamshell housing members 18 and 20 are molded plastic parts with their various portions described herein being formed integrally with each other. Corresponding portions on each of the symmetrical housing members 18 and 20 are identified by the same reference numeral with the portions on the first housing member 18 additionally provided with letter "a" and portions on the second housing member provided with the letter "b".

Figure 10:
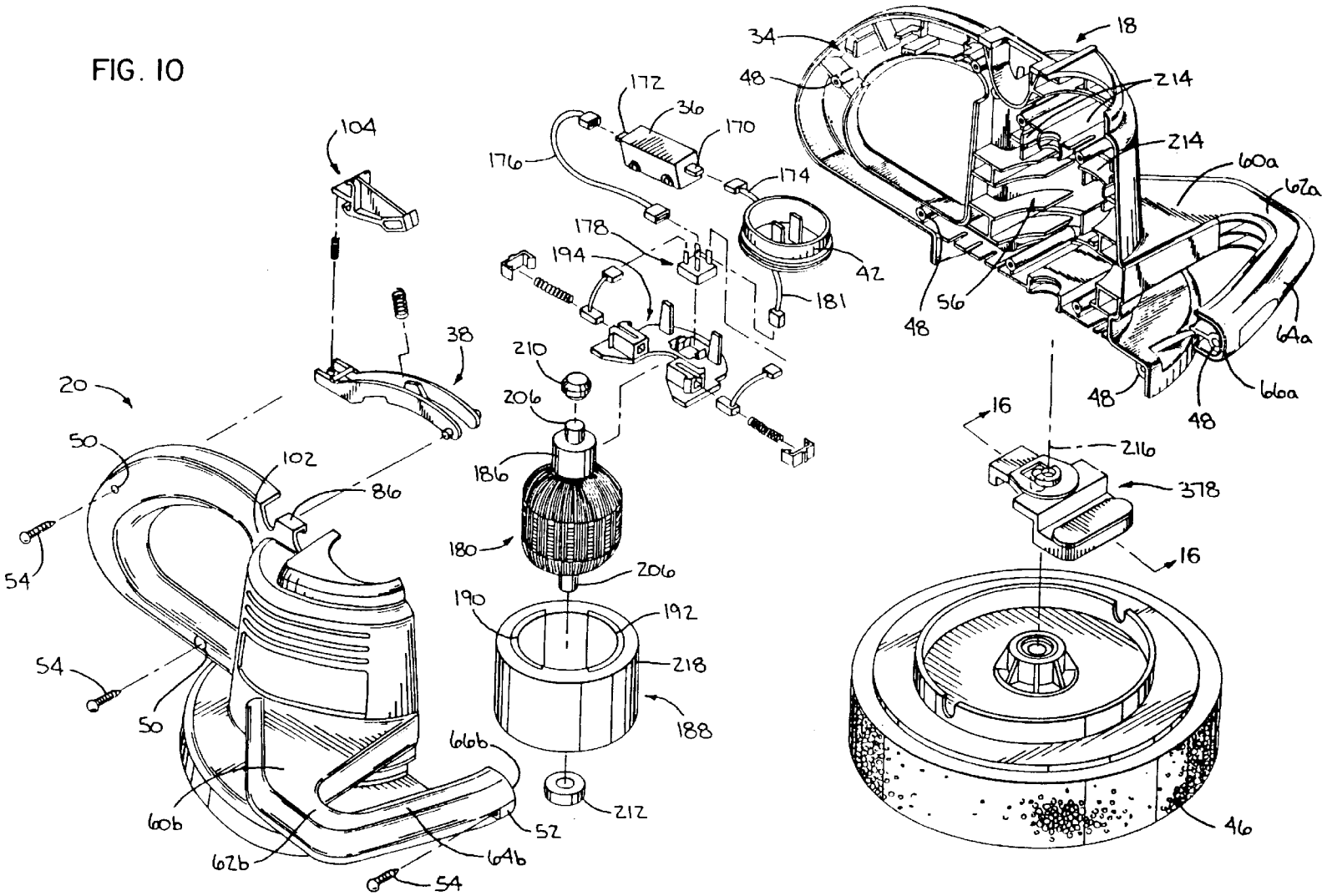
FIG. 10 is an exploded perspective view of the apparatus shown in FIG. 1 showing details of the arrangement of a DC motor having a support plate and rectifier assembly, the paddle actuator with a lock-on button, and the counterweight and pad assembly.
Figure 11:
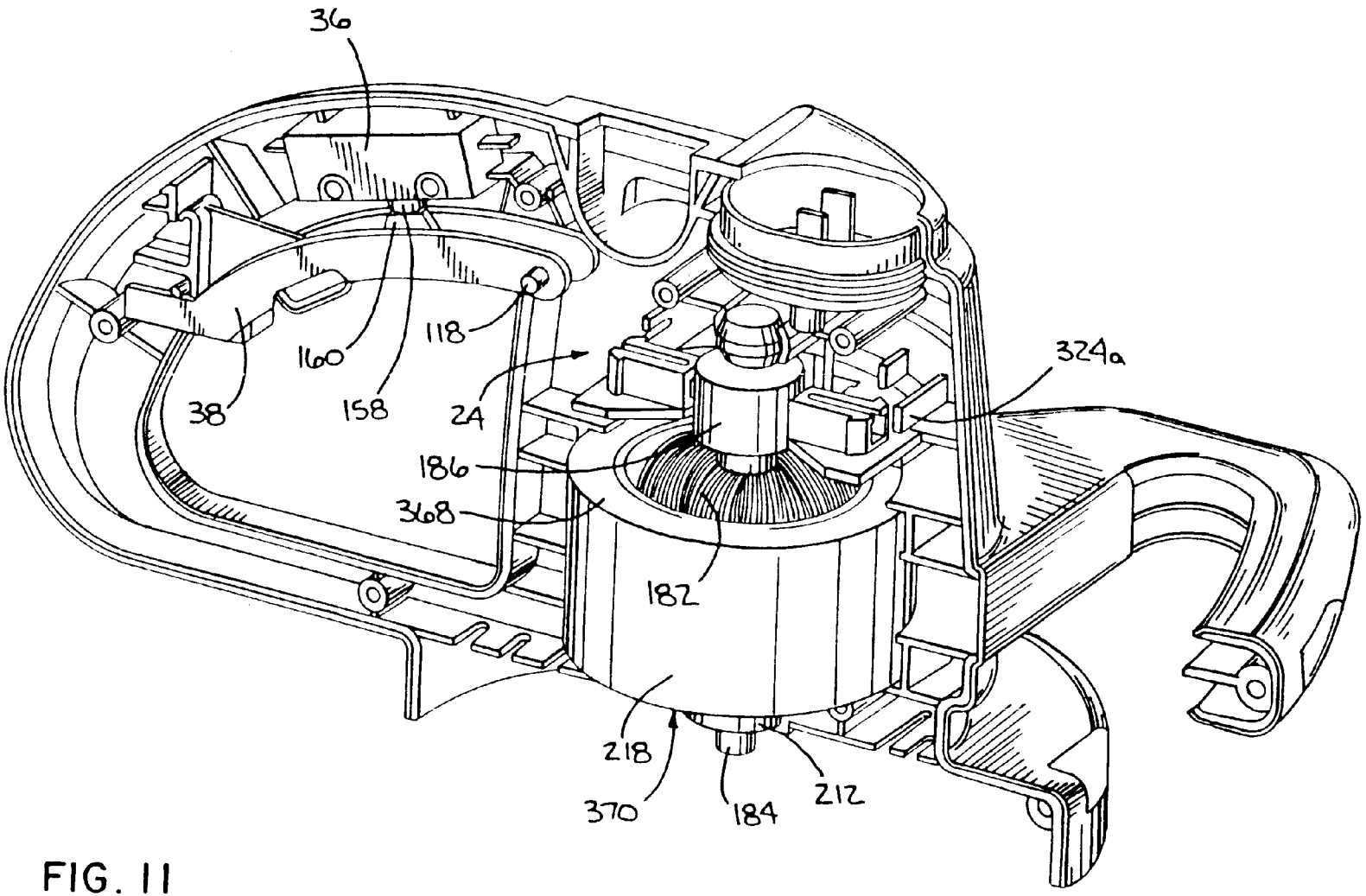
FIG. 11 is an enlarged perspective view of the motor and support plate assembly and the paddle actuator and its lock-on button mounted in the first clamshell housing member shown in FIG. 10.

The housing 16 includes a main central housing 22 in which the motor assembly 24 is mounted, as best seen in FIGS. 10 and 11. The main housing 22 includes a front handle 26 and a rear handle 28 extending therefrom. As illustrated in FIGS. 1–6, the main housing 22 includes a substantially flat top 30 and a bottom 32 and the front and rear handles 26 and 28 extend transversely to each other with the front handle 26 extending horizontally outwardly towards the forward end 12 from the main housing 22 between and substantially parallel to the top 30 and bottom 32 thereof while the rear handle 28 extends outwardly towards the rear end 14 from the main housing 22 and extends vertically and arcuately between the top 30 and bottom 32 of the main housing 22.

The rear handle 28 has a hollow interior 34 in which a box-shaped switch housing 36, for a switching mechanism 37 illustrated schematically in FIG. 22, and an actuator paddle 38 are mounted. The actuator paddle 38 extends from the interior 34 through a bottom slot 35 formed in handle 28 to a predetermined distance outside the rear handle interior 34 in a rear gripping aperture 39 bounded by the rear handle 28. The paddle 38 has an arcuate shape substantially matching the contour of the rear handle 28 so as to be easily and readily operable when the user grips the rear handle 28 along its arcuate portion as more fully described hereafter.

Figure 7:
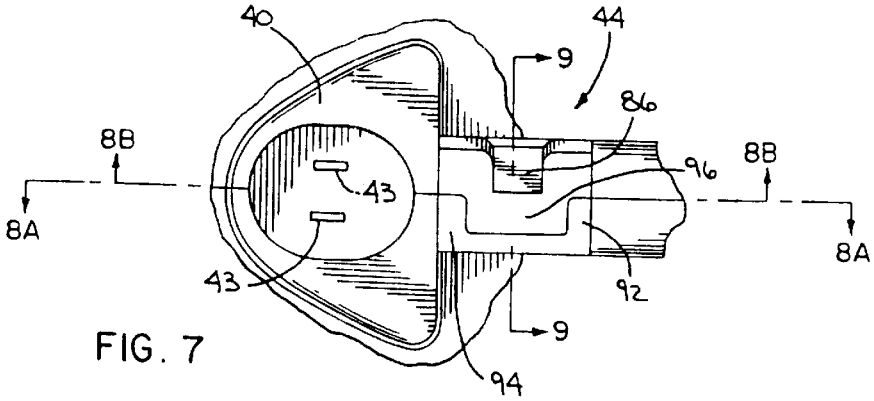
FIG. 7 is an enlarged top plan view of the cord lock and the collar and male receptacle assembly of the apparatus shown in FIG. 1, as seen in FIG. 3.

At the top 30 of the housing 16, a raised wedge-shaped collar region 40 is defined into which a male receptacle or plug plate 42 can be mounted for receiving a female socket head of an electrical cord (not shown) for electrically connecting an alternating current power source, for 110 volts at 60 Hz, to the motor assembly 24. Adjacent the collar region 40 towards the rearward end 14 of the housing 16, a cord locking mechanism 44 is defined in the housing top 30, as shown in FIGS. 7–9. The cord locking mechanism 44 prevents accidental disconnection of the female socket head connected in the collar region 40 to the male receptacle 42. Thus, with the motor 24 activated to drive a working element, such as a buffer pad 46, and with the buffer pad 46 driven in an orbital path as will be described more fully herein, the above-described design of the housing 16 allows an operator to easily manipulate the apparatus 10 of the present invention with two hands to exert bi-planar control over the apparatus 10 while the buffer pad 46 is moved along the working surface in its orbital path without having to grab the main housing 22 to effectively and accurately guide and control the pad 46 along the working surface. Also, the placement of the electrical connection between the apparatus 10 and the electrical cord supplying AC power thereto in a recessed location on the housing top 30 and with the cord-locking mechanism 44 adjacent thereto maintains the cord in place remotely from the interface between the pad 46 and the surface being worked upon, such as a car finish, while at the same time limiting disconnections interrupting the waxing, buffing or polishing process for which the apparatus 10 can be used.

Figure 20:
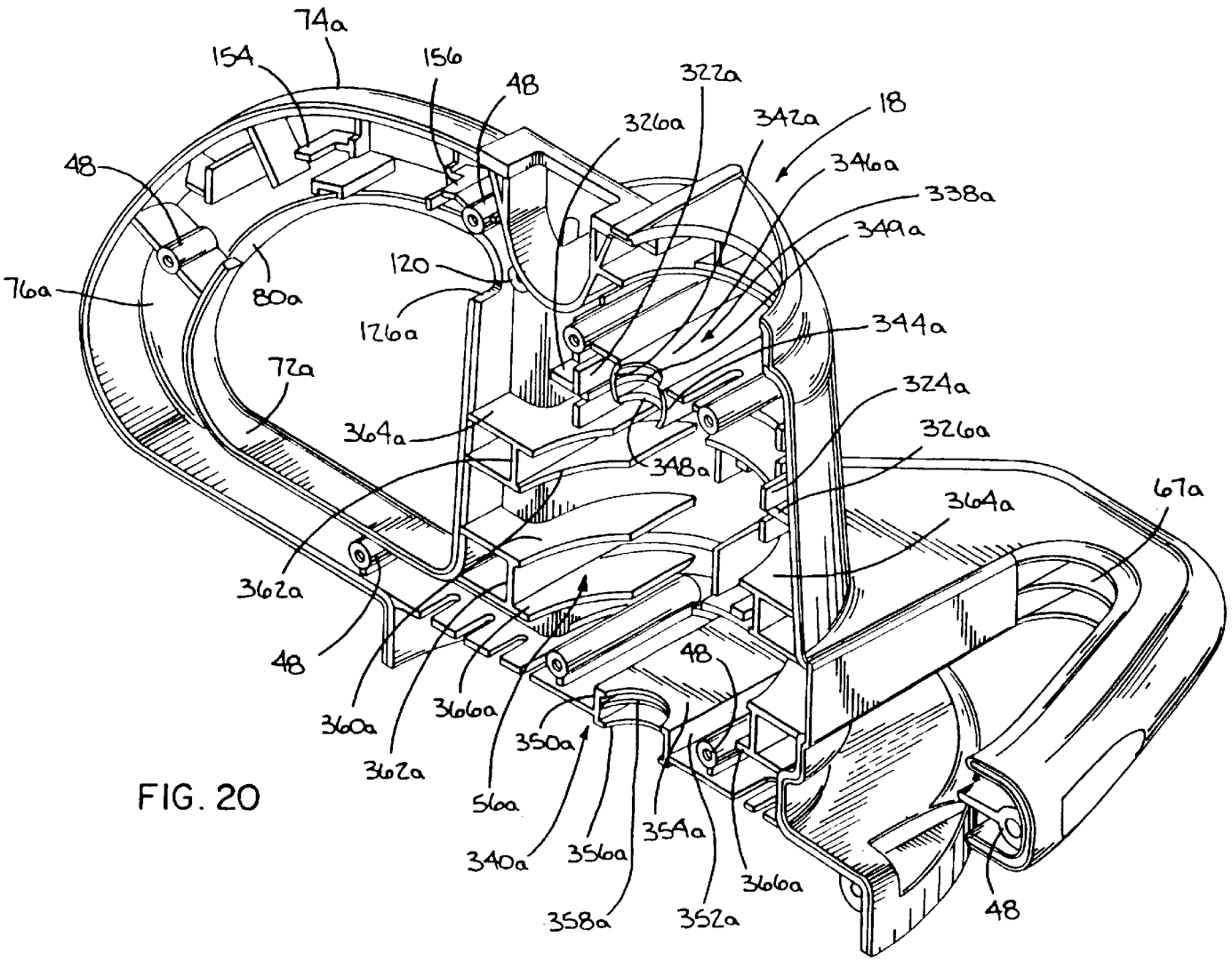
FIG. 20 is an enlarged perspective view of the first clamshell housing member.
Figure 21:
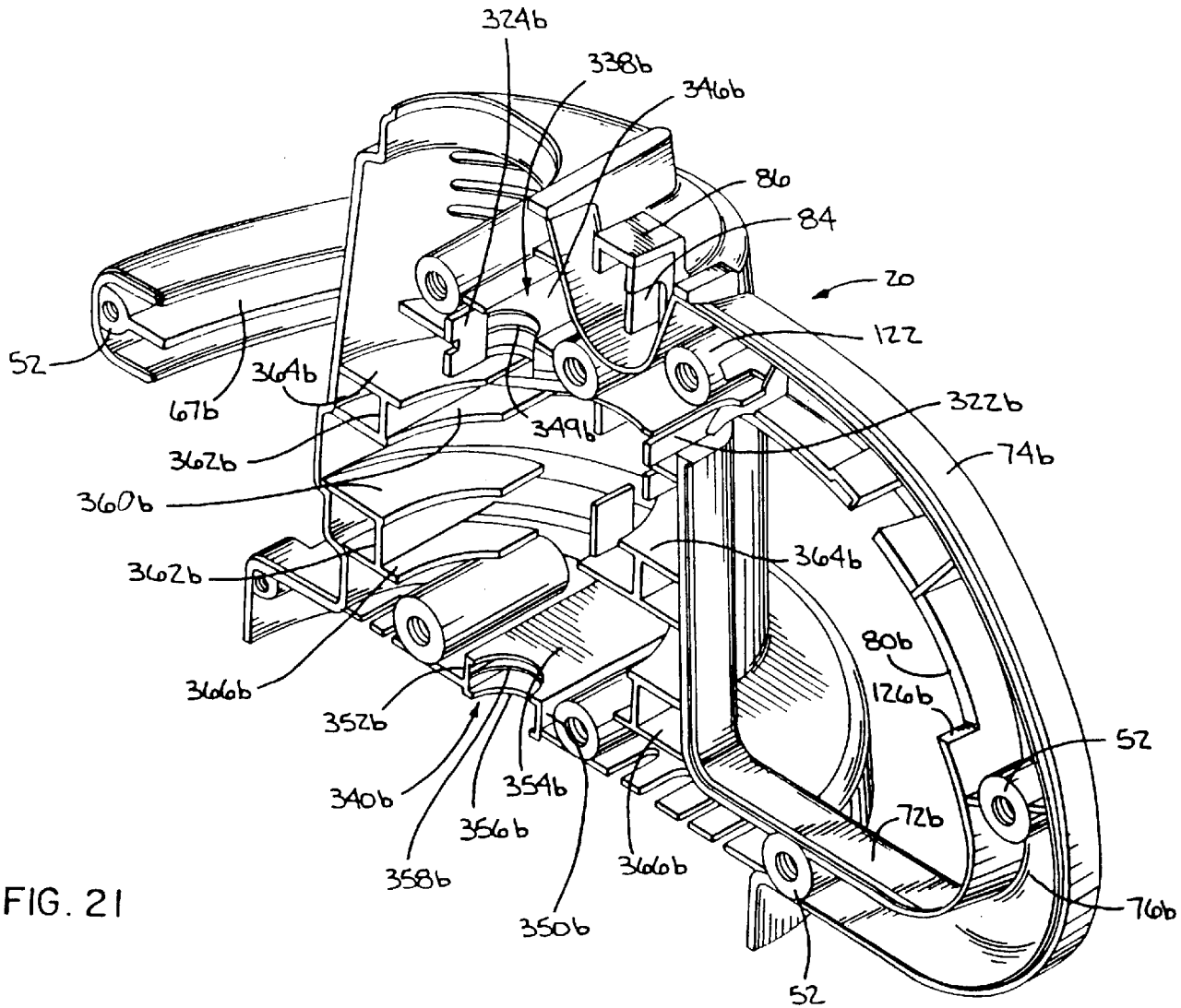
FIG. 21 is an enlarged perspective view of the second clamshell housing member.

Referring now more specifically to the configuration of the housing 16, it will be noted that the symmetrical clamshell housing members 18 and 20 cooperate to form the front and rear handles 26 and 28, the collar region 40 and the cord-locking mechanism 44 described above. More specifically and referencing FIG. 3, the clamshell housing member 18 includes main housing portion half 22*a*, front handle half 26*a*, rear handle half 28*a*, collar region half 40*a* and cord locking mechanism half 44*a*. Likewise, second clamshell housing member 20 includes main housing portion half 22*b*, front handle half 26*b*, rear handle half 28*b*, collar region half 40*b* and cord locking mechanism half 44*b*. The first clamshell housing member 18 is provided with threaded bosses 48 and the second clamshell housing member 20 has countersunk recesses 50 formed therein with each of the recesses 50 leading to a threaded boss 52, as seen in FIGS. 10, 20 and 21.

To assemble the apparatus 10, the internal components including the motor assembly 24, the switch housing 36, the actuator paddle 38 and the male receptacle 42 are mounted to the first clamshell housing member 18, as seen in FIG. 11, with the second clamshell housing member 20 then being arranged against the first clamshell housing member 18 so as to align the threaded bosses 52 of the housing member 20 with the corresponding threaded bosses 48 of the first clamshell housing member 18. With the housing members 18 and 20 so aligned, screws 54 received in threaded bosses 52 can be, in turn, received in corresponding bosses 48 to clamp the clamshell housing members 18 and 20 to each other with the heads of the screws 54 seated within the countersunk recesses 50 of the second housing member 20 so as not to protrude therefrom.

With the first and second clamshell housing members 18 and 20 attached to each other, the main housing portions 22*a* and 22*b* cooperate to define an interior space 56 in which the motor assembly 24 is mounted. As best seen in FIG. 3, the main housing portion 22 so formed has a pear-shaped cross-sectional configuration. The raised collar region 40 has a triangular shape in cross-section and, as previously mentioned, projects from the substantially flat top 30 of the housing 16. The wedge-shaped collar region 40 has an oblong central recessed area 58 into which the male receptacle 42 is placed.

Turning to the configuration of the front handle 26, each of the main housing portions 22*a* and 22*b* includes a triangular attached portion 60*a* and 60*b*, respectively, which extends horizontally outward and forward from the respective main housing portions 22*a* and 22*b* between and substantially parallel to the top 30 and the bottom 32 of the housing. From the outermost forward corner of the triangular portions 60*a* and 60*b* extend respective outer channel-shaped straight sections 62*a* and 62*b* such that with the clamshell housing members 18 and 20 attached to each other, the outer straight sections 62*a* and 62*b* extend substantially parallel to one another and the channels open towards each other. The straight sections 62*a* and 62*b* extend forwardly to angled channel-shaped gripping portions 64*a* and 64*b*, respectively, which extend at an angle from their respective straight sections 62*a* and 62*b* forwardly towards each other to distal ends 66*a* and 66*b* which abut one another along the part line 21 and define a bent section of the front handle 26 where the channels open rearwardly towards the main housing 22 with the clamshell housing members 18 and 20 attached.

Intermediate horizontal supporting members 67*a* and 67*b* extend within the channels of the respective straight sections 62*a* and 62*b* and angled gripping portions 64*a* and 64*b*, as best seen in FIGS. 20 and 21. Corresponding bosses 48 and 52 are formed on the intermediate supporting members 67*a* and 67*b* at the distal ends 66*a* and 66*b* and can be aligned with each other when the housing members 18 and 20 are brought together such that one of the screws 54 received in the aligned front handle threaded bosses will provide an attachment between the housing members 18 and 20 at the front handle distal ends 66*a* and 66*b*. In this manner, the front handle 26 is formed defining a forward gripping aperture 69 by the above-described connection between the angled portions 64*a* and 64*b*.

The clamshell housing members 18 and 20 also include rear handle arcuate gripping portions 68*a* and 68*b* which extend integrally from near the rear end of the top 30 of the main housing 22 and, more specifically, from the rear of the cord locking mechanism 44. The arcuate gripping portions 68*a* and 68*b* continue rearward and vertically downward to a point aligned with the bottom 32 of the main housing portion 22 so as to extend substantially through a quarter-circle arc. At this point, the rear handle 28 includes straight joining sections 70*a* and 70*b*, respectively, which extend from their respective arcuate gripping portions 68*a* and 68*b* back to the main housing portions 22*a* and 22*b* at the bottom 32 thereof. To join the rear handle portions 28*a* and 28*b*, one of the threaded bosses 48 is formed in the arcuate gripping portions 68*a* and one is formed in the straight joining section 70*a* along with corresponding threaded bosses 52 in the arcuate gripping portion 68*b* and straight joining section 70*b* such that with screws 54 received in the rear handle aligned bosses 48 and 52, the rear handle portions 28*a* and 28*b* are secured to each other to form the rear handle 28 and define the rearward gripping aperture 39.

As shown in FIGS. 20 and 21, the rear handle portions 28*a* and 28*b* are formed as channel-like members having opposing sidewalls with each including a smaller inner sidewall 72*a* and 72*b* and a larger outer sidewall 74*a* and 74*b* and a connecting web wall 76*a* and 76*b* spanning their respective inner and outer sidewalls 72 and 74 such that when the rear handle portions 28*a* and 28*b* are connected, they define a hollow rear handle 28 with the rear handle interior space 34 in which the switch housing 36 is mounted. Further, the inner sidewalls 72*a* and 72*b* each include respective cut-out sections 80*a* and 80*b* along the arcuate gripping portions 68*a* and 68*b* such that, with the rear handle portions 28*a* and 28*b* connected, the cut-out sections 80*a* and 80*b* cooperate to define the bottom slot 35 for the actuator paddle 38. With the actuator paddle 38 mounted in the rear handle interior space 34, the actuator paddle 38 includes a portion which extends through the bottom slot 35 into the rearward gripping aperture 39 spring biased to a predetermined distance beyond the inner sidewall 72.

The configuration of the cord locking mechanism 44 adjacent the collar region 40 will next be described with reference to FIGS. 7–9, 20 and 21. As previously mentioned, the cord locking mechanism 44 is disposed rearwardly of the raised wedge-shaped collar region 40 and includes a trough or well surface 82 defined by recessed U-shaped surfaces 82*a* and 82*b* in the respective main housing top portions 30*a* and 30*b*, as best seen in FIGS. 8A and 8B. An upstanding flange 84 extends from the bottom of the trough portion 82*b* to the top of the projecting wedge collar region 40 with a tab 86 formed thereat at right angles to the flange 84 and projecting over the trough 82 so that the top of the tab 86 is flush with the top of the wedge collar 40. Trough portion 82*a* has upstanding parallel side flanges 88 and 90 spaced from each other along either side of the trough portion 82*a* and having respective overhung lip portions 92 and 94 which project towards each other over the trough portion 82*a*.

Thus, when the housing members 18 and 20 are aligned and clamped together, the cord locking mechanism 44 is formed. With the female socket head on an electrical cord attached in the collar region 40 to the prongs 43 of the plug plate 42, the portion of the cord adjacent the female head can be inserted through the zig-zag entry slot 96 defined between the overhung lip portions 92 and 94 and the tab 86. The section of the cord adjacent the female head inserted through the entry slot 96 can be positioned so that it is clamped between the trough surface 82 and the overhung tab 86 positioned thereabove with the ends of the cord section extending around the upstanding flange 84 and through access openings 98 and 100 formed in the sidewall portion 102 of the trough surface 82*b* on either side of the flange 84. In practice, when the apparatus 10 is being used and the slack in the cord is taken up, as when the apparatus 10 is moved further away from the electrical outlet, tension created by tightening of the slack in the cords will be substantially taken up by the frictional engagement of the cord between the well surface 82 and the overhung tab 86 and lip portions 92 and 94 such that the interface of the female head with the male prongs 43 will experience little or no tension during normal usage of the appliance, thereby significantly reducing the potential occurrences of accidental disconnection at the interface.

Figure 13:
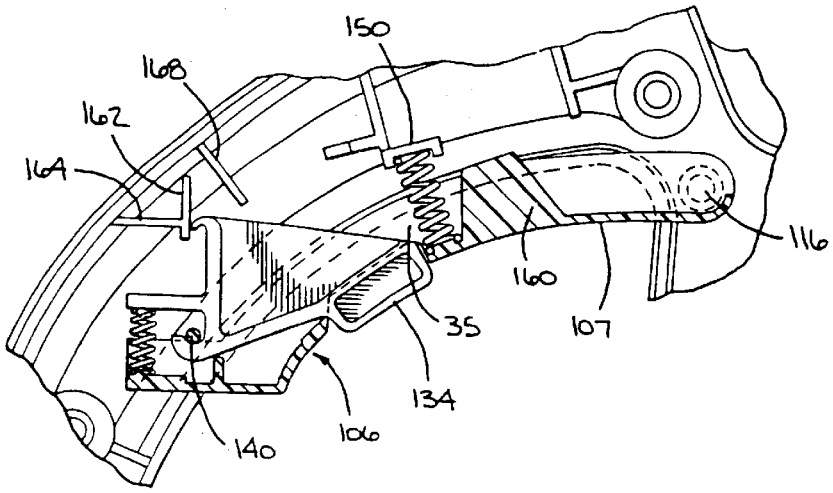
FIG. 13 is a side elevational view, partially in section, of the assembled paddle actuator and lock-on button assembly shown in FIG. 10.

Turning to FIGS. 12 and 13, the construction and operation of the actuator paddle 38 including a lock-on mechanism 104 which is mounted in nested relation therewith is illustrated. The actuator paddle 38 has an arcuate elongate channel-shape with a bottom surface 106 having an arcuate portion 107 provided with a radius of curvature substantially the same as the rear handle arcuate gripping portion 68 and being adapted to be gripped by an operator. Two upstanding parallel sidewalls 108 and 110 extend along either side of the bottom wall 106 such that the channel of the elongate arcuate-shaped actuator paddle 38 opens towards the rear handle interior space 34.

The elongate actuator paddle 38 has a forward end 112 and a rearward end 114 and includes a pair of trunnion pivots 116 and 118 extending laterally each from one of the sidewalls 108 and 110 at the forward end 112 of the paddle 38. The paddle 38 is mounted in the rear handle interior space 34 by a pair of corresponding trunnion mounts 120 and 122 in respective housing members 18 and 20. The trunnion mounts 120 and 122 are disposed adjacent the well 82 rearwardly thereof such that with the housing members 18 and 20 connected, the actuator paddle 38 will extend from the base of the well 82 along the curve of the arcuate rear handle gripping portion 68 to the rear end of the cut-out 80 therein. At the rearward end 114 of the paddle 38, a support 124 for the lock-on mechanism 104 is formed. With the trunnions 116 and 118 mounted in their respective trunnion mounts 120 and 122, the support 124 extends substantially horizontally and is normally biased into engagement with a transverse portion 126 of the inner sidewall 172 at the rear of the cut-out 80. A pair of spring pedestals 128 and 130 are formed on the bottom wall 106 with the forward pedestal 128 located on the arcuate portion 107 of the bottom wall 106 and the rear pedestal 130 located on the horizontal support portion 124 of the bottom wall 106.

The paddle 38 is further provided with an aperture 132 formed along its arcuate portion 107 in the bottom wall 106 and sidewalls 108 and 110 for receipt of the lock-on mechanism 104 therethrough. More specifically, the lock-on mechanism 104 includes a button 134 and a substantially flat base member 136 extending rearwardly therefrom. With the lock-on mechanism 104 assembled in nested relation to the actuator paddle 38 and the button 134 projecting through the paddle aperture 132, the base 136 extends from a support portion 137 formed on the backside of the arcuate portion 107 adjacent the rear of the button aperture 132 in the channel of the actuator paddle 38 and into the channel of the support portion 124 where the base 136 has a curved end 138 which is adapted to engage a pivot rod 140 fixed to the paddle 38 extending across the sidewalls 108 and 110 in the support portion 124. Partition wall 141 extends along the back of the button 134 and the flat portion of the base 136 and upwardly beyond the channel formed by the paddle 38 where it ends at a transverse wall 142 upstanding from the base 136 with the transverse wall 142 similarly extending upwardly beyond the channel of the paddle 38. At the top of the transverse wall 132, a curved cam surface 144 is formed for locking the paddle 138 in a closed position, as will be more fully described hereafter.

Above the curved end 138 and below the curved cam surface 144, an intermediate spring engaging member 146 extends rearwardly from the transverse wall 142. A small spring 148 is mounted in compression between the intermediate spring engaging member 146 and the bottom wall 106 in the support 124 encircling the spring pedestal 130. In this manner, the lock-on mechanism 104 is normally biased about pivot rod 140 so that the button member 134 extends through the paddle aperture 132. The rear handle portion 28*a* includes a spring-engaging flange 150 formed in the rear handle interior space 34 disposed along the cut-out 80 of the rear handle 28. A large spring 152 is mounted in compression between the spring-engaging flange 150 and the base 136 and encircling the spring pedestal 128 to normally bias the actuator paddle 38 to an open position where the paddle 38 projects from the slot 80 in the rear handle inner sidewall 82 into the rear gripping aperture 39.

The rear handle portion 28 has switch supporting bracket ribs 154 and 156 formed in the rear handle interior space 34 along the cut-out slot 80 with the ribs 154 and 156 framing and supporting either side of the box switch housing 36. The switch housing 36 includes an activation plunger 158 (see FIG. 11) extending therefrom and the actuator paddle 38 includes an upstanding trapezoidal flange or actuating member 160 forwardly of the aperture 132 and the pedestal 128 adapted to engage the activation plunger 158 when the paddle 38 is depressed.

In practice, an operator can readily use one hand wrapped about the rear handle 28 to properly orient the buffer pad 46 over the surface on which work, e.g., buffing, polishing or the like, is to be performed. As the rear handle 28 extends back from the main housing 22, below which is mounted the pad 46, the operator can use the rear handle 28 to reach a large region of a work surface from a relatively stationary position. Once the pad 46 is properly oriented above the work surface, the actuator paddle 38 can be depressed against the spring bias to a closed position with the paddle 38 pivoting about its forward trunnions 116 and 118 and carrying the lock-on mechanism 104 therewith as by engagement of the support portion 137 with the base 136 of the lock-on mechanism 104. With the paddle 38 so depressed, the flange 160 engages and likewise depresses the activation plunger 158 closing the switch circuit (see FIG. 22) to activate the motor assembly 24 and drive the pad 46 in its orbital path.

By providing an elongate, arcuate paddle 38 which follows the contour of the arcuate rear handle gripping portion 68 an operator can grab the rear handle 28 at various positions along the gripping portion 68, while still being able to depress the paddle 38 to its operative position without requiring an independent operation with their other hand and/or before the operator is ready to support and maneuver the apparatus 10 by the rear handle 28 during operation thereof. To deactivate the motor assembly 24, and therefore the apparatus 10, an operator need merely release the actuator paddle 38 which, by virtue of being spring loaded to its extended open position, will deactivate the motor assembly 24 by disengagement of the flange 160 from the activation plunger 158 to open the switch circuit.

In addition, if an operator does not wish to continually depress the paddle 38 during operation of the apparatus 10, the lock-on mechanism 104 can be readily accessed and utilized in an easy manner without interrupting operation of the apparatus 10 and/or requiring use of the operator's other hand. As previously mentioned, the lock-on mechanism 104 includes the transverse wall 142 extending into the rear handle interior space 34. In the interior space 34, a locking flange 162 is connected to the outer sidewall 74*a* disposed over the inner sidewall transverse portion 126 and includes a horizontal portion 164 and a connected vertical portion 166. Cooperating with the lock flange 162 is a guide flange 168 connected to the outer sidewall 74*a* and spaced forwardly from the vertical portion 166.

The paddle 38 and lock-on mechanism 104 are arranged so that with the paddle 38 depressed to its operative position, the cam end 144 will be positioned near the top of the vertical portion 166 between it and the guide flange 168. To continuously use the apparatus 10 without having to correspondingly continuously depress the paddle 38 to its operative position, the button member 134 can be depressed towards the rear handle interior space 34, i.e., in the same direction in which the actuator paddle 38 is being depressed, against the bias of spring 148, causing the outside of the curved cam surface 144 to cammingly engage the guide flange 168 and be directed over the top of the vertical portion 166 of the lock flange 162 and latch onto the lock flange vertical portion 166 under the influence of large spring 152 with the actuator 38 being maintained in its closed operative position by the lifting force applied by the curved end 138 on the pivot rod 140. To effect release of the actuator paddle 38 from the locked position, the operator merely depresses the paddle 38 slightly further to reduce the influence of large spring 152 sufficiently so as to allow the spring 148 to urge the curved cam end 144 over the top of the lock flange vertical portion 166 and against the guide flange 168 as by the pivoting action of the curved end 138 about the pivot rod 140. Thereafter, the paddle 38 is released with the spring 150 biasing the paddle 38 to the open position to deactivate the motor assembly 24.

To provide electrical power from the plug plate 42 to the motor assembly 24, the switching mechanism 37 includes an input terminal 170 and an output terminal 172 extending through sides of the switch housing 36. As best seen in FIG. 10, a lead 174 is electrically connected to the plug plate 42 and extends to the switching mechanism input terminal 170 while another lead 176 extends from the output terminal 172 to a fullwave rectifier 178 for the DC motor assembly 24. A lead 181 is electrically connected to the plug plate 42 and extends directly to the rectifier 178. As is conventional, the rectifier 178 converts AC power received at the plug plate 42 to DC power for application to the DC motor assembly 24. Thus, with the switching circuit closed as caused by depressing the paddle 38 to its operative position, DC electrical power will be provided to the armature coils, as more fully discussed herein.

The various motor assembly components are supported and oriented directly by the clamshell housing members 18 and 20 which, when connected, cooperate to clamp the motor in place in the main housing 22 without employing an extended yoke as a container to support and position the various motor components and/or a separate base or frame member to support the yoke in the housing. Referring to FIGS. 10 and 11, the motor assembly 24 consists of an armature 180 which can be of standard construction, including a core and windings 182 aligned around a shaft 184 on which is also mounted the commutator 186. A steel stator yoke 188 of open cylindrical shape is provided and can have a pair of large semi-circular permanent magnets 190 and 192 pressed therein with the magnets 190 and 192 having a half-inch gap between each other in the yoke 188 at their ends.

Figure 14:
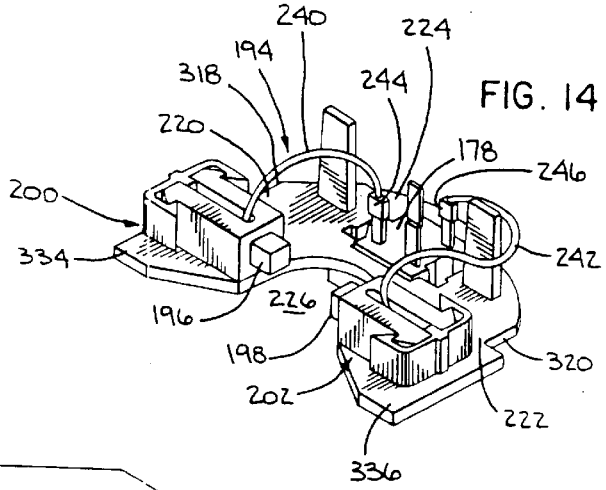
FIG. 14 is a perspective view of the assembled support plate and rectifier assembly shown in FIG. 10.
Figure 15:
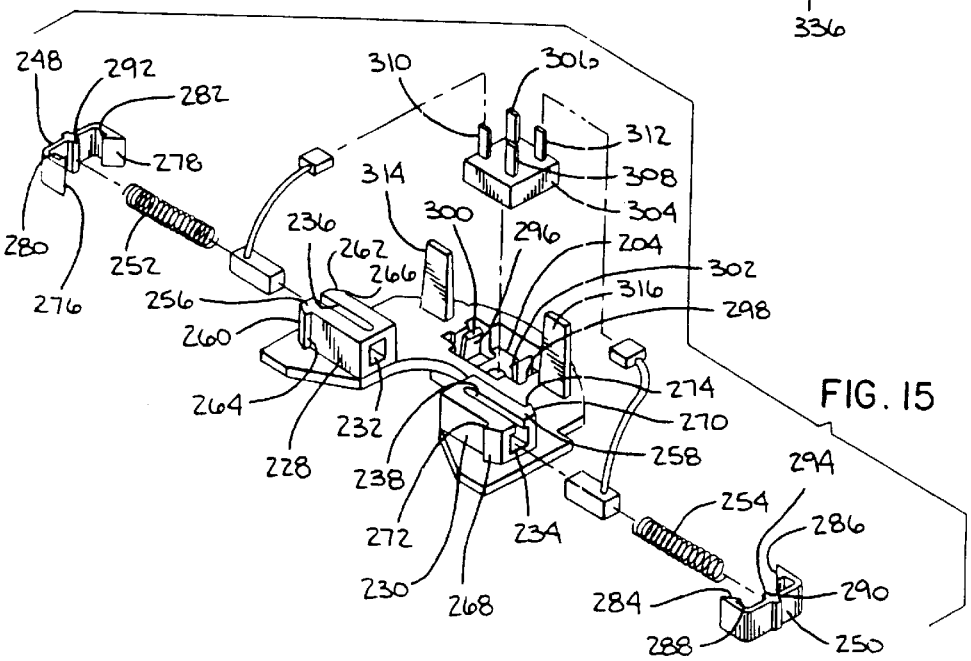
FIG. 15 is an exploded view of the support plate and rectifier assembly shown in FIG. 14.

A support plate 194 mounts the brushes 196 and 198 in respective brush housings 200 and 202 thereon and the rectifier 178 in a rectifier well 204 formed therein, as illustrated in FIGS. 14 and 15. Referring to FIGS. 10 and 11, the armature shaft 184 includes top and bottom ends 206 and 208 with a spherical bushing 210 being mounted about the top end 206 of the shaft 184 and a ring ball bearing 212 being mounted about the shaft 184 near its bottom end 208.

The first and second housing members 18 and 20 each include a plurality of alignment and support members generally designated 214 which are symmetrically arranged about a longitudinal axis 216 extending centrally through the main housing 22. The alignment and support members 214 clampingly engage the outer surface 218 of the yoke 188 and tightly capture the top and bottom bearings 210 and 212 when the housing members 18 and 20 are secured to each other so that the yoke 188 and the armature 180 are in alignment along the longitudinal axis 216 with the armature shaft 184 extending therealong and the cylindrical yoke 188 encircling the armature 180. In this manner, the motor assembly 24 and the housing 16 are assembled together in one manufacturing operation without requiring a separate assembly operation for the motor before it is mounted in the housing. In addition, the motor circuitry including the switch housing 36, the plug plate 42 and the support plate 194, including the brushes 196 and 198 and the rectifier 178 can be assembled as a sub-assembly before the they are mounted to the housing 16.

More specifically and referring to FIGS. 14 and 15, the support plate 194 preferably has a U-shape having opposed leg portions 220 and 222 and a transverse foot portion 224 which extends between and cooperates with the leg portions 220 and 222 to define a central commutator space 226. The support plate 194 is mounted in the housing 16 such that the leg portions 220 and 222 are spaced on either side of the commutator 186 with the commutator 186 positioned in the central space 226. The brush housing 200 is mounted on leg portion 220 and the brush housing 202 is mounted on leg portion 222 spaced 180° from each other around the commutator 186. The brush housings 200 and 202 each include a main body 228 and 230, respectively, having respective brush-receiving bores 232 and 234 extending therethrough. Central guide slots 236 and 238 are formed in the top of the main bodies 228 and 230, respectively, with the guide slots 236 and 238 communicating with respective bores 232 and 234. The brushes 196 and 198 are received in their respective brush-receiving bores 232 and 234 and include attached leads 240 and 242, respectively, each having respective flag terminals 244 and 246 for electrically connecting the brushes 196 and 198 to the rectifier 178.

With the brushes 196 and 198 placed in their bores 232 and 234, and the support plate 194 mounted in the housing 16 about the commutator 186, the brushes 196 and 198 are biased so that at least a portion thereof extend into the central space 226 into contact with the outer surface 218 of the commutator 186. In this manner, the brushes 196 and 198 slidingly ride along the commutator outer surface 218 as it rotates on the armature shaft 184 to thereby electrically connect the power source to the armature coils. To urge the brushes 196 and 198 into contact with the commutator 186, each of the housings 200 and 202 include respective caps 248 and 250 and springs 252 and 254. The main body 228 and the main body 230 include enlarged outer ends 256 and 258, respectively. The enlarged outer end 256 includes oppositely-facing ramp surfaces 260 and 262 extending inwardly to respective straight shoulder surfaces 264 and 266. Likewise, enlarged end 258 includes oppositely-facing ramp surfaces 268 and 270 extending inwardly to respective straight shoulder surfaces 272 and 274.

For capturing and locking the cap 248 on the main body 228, the cap 248 includes a pair of ramp surfaces 276 and 278 extending from either side thereof to respective inner shoulder surfaces 280 and 282. Likewise, cap 250 is provided with ramp surfaces 284 and 286 extending from either side thereof to respective shoulder surfaces 288 and 290. The inner rear surfaces of each of the caps 248 and 250 is provided with a slightly raised spring locating boss 292 and 294, respectively.

To assemble the brushes 196 and 198 in their respective housings 200 and 202, the brushes 196 and 198 are inserted into their respective bores 232 and 234 with their lead wires 240 and 242 extending from the bores 232 and 234 through the slots 236 and 238 thereof with the flag terminals 244 and 246 then being connected to appropriate output terminals on the rectifier 178, as will be described herein. To urge the brush 196 through the bore 232 of the housing 228 and into the central space 226, the spring 252 is placed in the bore 232 with one end in contact with the brush 196 and its other end located on the boss 292 with the cap 248 then being press fit onto the enlarged end 256 of the main body 228 of the housing 200. The cap 248 is press fit onto the main body 228 by moving the ramp surfaces 276 and 278 against and along the ramp surfaces 260 and 262 so as to urge the cap sides outwardly as the cap 248 is pushed onto the main body 228. Once the ramp surfaces are pushed past each other, the sides of the cap 248 will rebound to their original, straight configuration with the cap shoulder surfaces 280 and 282 confronting respective shoulder surfaces 264 and 266 on the main body so as to lock the cap 248 thereon. With the cap 248 locked in place, the spring 252 will act to bias the brush 196 so that it extends out from the central bore 232 into the central space 226, limited by the engagement of the lead 240 with the inner end of the guide slot 236, as best seen in FIG. 13. The cap 250 is similarly press-fit and locked onto the main body 230 so as to bias the brush 198 through the bore 234 into the central space 226.

In the foot portion 224 of the support plate 194, the recessed rectifier well 204 is formed. The rectifier well 204 includes a pair of resilient upstanding locking members 296 and 298 therein, with the locking members 296 and 298 each having an enlarged locking portion 300 and 302 at their respective upper ends. The rectifier 178 includes a body portion 304 with a pair of input terminals 306 and 308 and a pair of output terminals 310 and 312 extending from the body portion 304. The rectifier 178 is assembled in the rectifier well 204 by pushing the rectifier body portion 304 against the enlarged ends 300 and 302 of the resilient locking members 296 and 298. This causes the locking members 296 and 298 to be urged outwardly thereby allowing the rectifier body portion 304 to be pushed past the enlarged ends 300 and 302 to seat in the well 204 with the resilient locking members 296 and 298 then snapping back to a locking position with the enlarged ends 300 and 302 abutting against the upper face of the body portion 304 to tightly capture the rectifier 178 in the recessed well 204.

A pair of lead guiding stakes 314 and 316 extend from the support plate 194 substantially at the junctures of the support plate foot portion 224 with the leg portions 220 and 222. The sub-assembly of the plug plate 42, the switch housing 36, and the rectifier 178 and brushes 196 and 198 on the support plate 194 includes lead electrical connections as described below. As one skilled in the art will appreciate, various arrangements of lead wires can be utilized with the motor assembly 24 to transmit electrical power thereto. Preferably, the lead 174 is electrically connected at one end to the plug plate 42 and at its other end it has a flag terminal 174*a* which is electrically connected to the input terminal 170 of the switching mechanism 37. The lead 176 has a flag terminal 176*a* attached to the output terminal 172 of the switching mechanism 27 with its other flag terminal 176*b* at the other end of the lead 17 attached to one of the input terminals 306 and 308 of the rectifier 178. The lead 181 is electrically connected at one end to the plug plate 42 and at its other end it has a flag terminal 181*a* which is attached to the other one of the rectifier input terminals 306 and 308. The brush leads 240 and 242 are each electrically connected to one of the output terminals 310 and 312 preferably with flag terminal 244 connected to output terminal 310 and flag terminal 246 connected to output terminal 312, as seen in FIG. 14. To ensure that the non-insulated braided lead wire 242 is isolated from the other similarly non-insulated braided wires, the lead wire 242 extends from the guide slot 238 around the lead guiding stake 316 and to the output terminal 312. As is apparent, the lead guiding stakes 314 and 316 can be used to guide the lead wires connecting to the rectifier terminals in various arrangements so as to prevent the non-insulated lead wires from contacting each other.

For mounting of the rectifier and brush support plate 194 in the housing interior space 56, cut-outs defining shoulders 318 and 320 are formed along the outer edges of the support plate leg portions 220 and 222, respectively. Referring to FIGS. 11 and 20, the alignment and support members 214 of the housing member 18 include a pair of notched vertical ribs 322*a* and 324*a* with each of the vertical ribs including a horizontal abutment member 326*a* and 328*a* extending laterally from the notched area to the housing member 18. The vertical ribs 322*a* and 324*a* are laterally spaced from each other in the housing internal space portion 56*a* with the spacing corresponding to the distance between the support plate shoulders 318 and 320 so as to snugly receive the support plate shoulders 318 and 320 in the vertical rib notches against the abutments 326*a* and 328*a* when the plate 194 is mounted to the housing member 18. With the support plate 194 so mounted, the longitudinal axis 216 extends through the support plate central space 226.

To clamp the support plate 194 in the housing interior space 56, corresponding notched vertical ribs 322*b* and 324*b* are formed in housing member 20 (see FIG. 21) with their notches being vertically aligned with the notches in the vertical ribs 322*a* and 324*a* when the housing members 18 and 20 are connected. The notched vertical ribs 322*b* and 324*b* engage the ends 334 and 336 of the support plate leg portions 220 and 222 projecting beyond the respective brush housing 228 and 230 so as to clamp the support plate 194 against movement in the housing interior space 56.

To mount the armature 180 in the housing interior space 56 with the armature shaft 184 aligned along the longitudinal axis 216, the alignment and support members 214 include upper and lower bearing engaging members 338*a* and 340*a* in housing member 18 and corresponding upper and lower bearing engaging members 338*b* and 340*b* in housing member 20 which cooperate to form top and bottom pockets in the housing interior space 56 with the longitudinal axis 216 extending through these pockets. The pockets formed by the bearing engaging members 338 and 340 are configured so as to securely capture the respective top and bottom bearings 210 and 212 against movement in the housing interior space 56.

More specifically, since the top bearing 210 is preferably a spherical bearing, the top bearing engaging member 338 is formed with a pair of curved sidewalls 342 and 344 with the radius of curvature of the sidewalls 342 and 344 substantially matching that of the spherical bearing 210. In this manner, the spherical bearing 210 is prevented from moving axially along the longitudinal axis 216 when captured by the upper bearing engaging member 338 in the housing interior space 56. In addition, the curved sidewalls 342 and 344 are connected by horizontal top and bottom members 346 and 348 with the top and bottom members 346 and 348 being curved at their ends adjacent the longitudinal axis 216. Extending between the curved sidewalls 342 and 344 intermediate the top and bottom members 346 and 348 is a horizontal support rib 349 having a curved end which does not extend as far towards the axis 216 as the ends of the top and bottom members 346 and 348 to accommodate and match the shape of the spherical bearing 210. Thus, the diameter across the curved ends of the intermediate support ribs 349*a* and 349*b* in each of the housing members 18 and 20 when attached is substantially the same as the largest diameter extending across the middle of the spherical bearing 210. Similarly, the diameter across the curved ends of the horizontal top and bottom members 346 and 348 substantially matches the smaller diameter across the top and bottom of the spherical bearing 210 so as to prevent the same from moving in a lateral direction when clamped and captured in the housing interior space 56.

The lower bearing engaging member 340 is constructed similarly to the top bearing engaging member 338 except that it is configured so as to capture the lower bearing 212 which is preferably in the form of a ring ball bearing. Thus, the lower bearing engaging member 340 has a pair of spaced straight sidewalls 350 and 352. The sidewalls 350 and 352 are interconnected by horizontal top and bottom members 354 and 356 with the top and bottom members 354 and 356 having curved ends which terminate in straight end portions extending to the respective tops and bottoms of sidewalls 350 and 352. With the housing members 18 and 20 attached, the curved ends of the top and bottom members 354*a* and 354*b* and 356*a* and 356*b* define a diameter slightly smaller than the outer diameter of the ring bearing 212. Thus, with the ring bearing 212 secured and mounted in the lower bearing engaging member 340, the top and bottom members 354 and 356 prevent the bottom ring bearing 212 from moving axially along the longitudinal axis 216.

Extending between the sidewalls 350 and 352 intermediate the top and bottom members 354 and 356 is a horizontal support rib 358 having a curved end terminating at the sidewalls 350 and 352 such that with the housing members 18 and 20 connected together, the intermediate horizontal support rib portions 358*a* and 358*b* of each of the housing members define a diameter across their curved ends substantially corresponding to the outer diameter of the ring bearing 212 so as to capture the same against movement in a lateral direction in the housing interior space 56. Thus, with the armature shaft 184 mounted for rotation in upper spherical bearing 210 and the lower ring bearing 212 and with the bearings 210 and 212 clamped in the housing interior space 56 in the pockets formed by the bearing engaging members 338 and 340, the armature 180 along with its commutator 186 will be aligned for rotation on the shaft 184 extending along the longitudinal axis 216.

The cylindrical stator yoke 188 is mounted in the housing interior space 56 so that it encircles the armature core and windings 182 in alignment about the longitudinal axis 216. To mount the cylindrical yoke 188 in alignment about the axis 216, the alignment and support members 214 include horizontal arcuate ledges 360, vertically spaced in the housing members 18 and 20, as best seen in FIGS. 20 and 21. Interconnecting pairs of vertically-spaced arcuate ledges 360 are vertical reinforcing ribs 362. The ledges 360 include uppermost arcuate ledges 364 and lowermost arcuate horizontal ledges 366 which extend horizontally slightly further towards the axis 216 than do the other arcuate ledges 360 therebetween so that when the housing members 18 and 20 are attached, aligned uppermost ledges 364*a* and 364*b* in respective housing members 18 and 20 and aligned lowermost ledges 366*a* and 366*b* in respective housing members 18 and 20 cooperate to define a diameter which is slightly less than the diameter across the yoke outer surface 218. In this manner, the uppermost ledges 364 extend over the top end surface 368 of the yoke 188 and the bottom ledges 366 extend below the bottom end surface 370 of the yoke 188 so that the yoke 188 is tightly captured between the upper and lower ledges 364 and 366 against axial movement along the longitudinal axis 216.

To capture the yoke 188 against lateral movement in the interior space 56, the intermediate arcuate ledges 360 have a radius of curvature substantially matching the radius of curvature of the cylindrical yoke 188 so that together the arcuate ledges 360 define a diameter substantially the same as the yoke outer surface diameter. As previously mentioned, the housing members 18 and 20 are preferably molded plastic parts and the alignment and support members 214 including the horizontal ledges 360 are preferably integrally formed therewith. In this manner, the arcuate ends of the plastic ledges 360 can resiliently engage the outer surface 218 of the yoke 188 when the housing members 18 and 20 are connected to each other so as to clamp the yoke 188 within the interior space 56 in alignment about the longitudinal axis 216 and in encircling relation to the armature core and windings 182 with the clamping force being transmitted from the force applied in inserting the screws 254 in aligned bosses 48 and 52.

The mounting of the DC motor components directly to the housing members 18 and 20 by the clamping action therebetween provides significant cost savings in the manufacture of the apparatus 10 as the motor assembly 24 no longer needs to be assembled in a separate assembly operation and, instead, can be incorporated into the same assembly operation for the apparatus 10. In addition, the motor assembly 24 does not require the "can" form for the yoke 188 which required an extended yoke having cap and bearing plates to close the cylindrical yoke ends nor does the motor assembly 24 require an independent base or frame for mounting the "can" motor thereto. Typically the rectifier is mounted adjacent to the "can" motor, as on the motor frame, with provision being made to allow the leads from the motor brushes to extend through the motor housing to be electrically connected to the rectifier exterior of the motor housing. Thus, cost savings are obtained by minimizing the time required for assembly as well as by eliminating parts associated with a "can" type motor and allowing for uninterrupted paths for the leads between the brushes and rectifier.

As previously mentioned, preferably the apparatus 10 mounts a pad 46 for buffing, waxing, polishing or the like. In this form, the housing 16 can be provided with a sheath 372 formed at the bottom thereof with the sheath 372 having an annular portion 374 extending outwardly from the bottom 32 of the main housing portion 22 aligned about the longitudinal axis 216. Depending from the annular portion 374 is a circumferential skirt 376 from which the buffer pad 46 can project.

To allow the buffer pad 46 to stably move in an orbital path as it is driven, a counterweight assembly 378 is provided. The counterweight assembly 378 includes a pad mounting post 380 mounted thereto for allowing the pad 46 to be quickly mounted to the apparatus 10 and removed therefrom.

More specifically and referring to FIGS. 16–19, the counterweight assembly 378 includes a flat, elevated mounting portion 382 and a lower counterweight portion 384 offset from the elevated mounting 382. The elevated mounting portion 382 includes a threaded aperture 386 therethrough for receiving the threaded end 208 of the armature shaft 184 projecting through the ring ball bearing 212. Thus, with the armature shaft end 208 threaded in the aperture 386, the counterweight assembly 378 is mounted to the apparatus 10 for rotation with the shaft 184.

The quick-change pad mounting post 380 is connected to elevated mounting portion 382 adjacent the threaded aperture 386 and mounts the buffer pad 46 such that rotation of the counterweight assembly 378 by virtue of the attachment of the armature shaft 184 in the aperture 386 produces a substantially circular orbital path in which the pad 46 is moved about the shaft 184 and thus, the longitudinal axis 216. Since the mounting post 380 will be aligned with the center of the pad 46 as described herein and the shaft 184 is between the post 380 and the counterweight portion 384, as the counterweight assembly 378 is rotated, the counterweight portion 384 will always be disposed over the smaller portion of the pad as defined by a chord line drawn so as to extend across the circular pad 46 through the shaft 184 and across the width of the counterweight assembly 378. In this manner, the counterweight portion 384 acts to counter forces generated during rotation of the pad 46 in its orbital path which otherwise would tend to de-stabilize the apparatus 10.

The pad 46 can be of conventional construction and, in a preferred form has a 9-inch diameter. The pad 46 includes a plastic pad mounting plate 388 attached to its top surface. Projecting upwardly from the center of the pad mounting plate 388 is an annular post receiving member 390 having a central bore 392 extending therethrough in alignment with the central axial bore of the pad 46. The central bore 392 can have an axial sleeve 394 fixed therein with an axial lining 396 rotatably mounted in the axial sleeve 394 as by bearings (not shown).

The post 380 has a recess 398 machined near the lower end 400 of the post 380. For removably mounting mount the pad 46 to the quick-change pad mounting post 380, a detent ball 402 attached to a plastic backing 404, such as polyurethane, is secured in the recess 398. The recess 398 has a diameter across its opening slightly larger than the diameter of the detent ball 402 such that the ball 402 is snugly received in the recess 398 when attached therein. With the ball 402 attached in the recess 398 by way of the plastic backing 404, the ball 402 protrudes at a predetermined distance beyond the surface of the post 380 to an extended position. As the ball 402 is mounted on the plastic backing 404, the ball 402 can be depressed by exerting a force on the ball 402 which compresses the plastic backing 404 so that the ball 402 is flush with the surface of the post 380.

To move the detent ball 402 to its depressed position, the axial lining 396 has a diameter substantially the same as the diameter of the pad mounting post 380 so that insertion of the post 380 in the lining 396 causes the lower curved surface portion 406 of the ball 402 to initially engage the upper annular end 405 of the sleeve 394. Continued downward force applied to the counterweight assembly 398, and thus to the post 380, causes the axial lining 396 to cam over the curved surface portion 406 by application of a predetermined inwardly directed force to move the ball 402 radially inwardly to a position flush with the post surface against the bias provided by the plastic backing 404.

With the ball 402 in its depressed, flush position relative to the post 380, the post 380 can be readily pushed through the axial sleeve 394 until the bottom 408 of the elevated mounting portion 382 rests against the top 410 of the raised annular member 390 with the counterweight portion 384 adjacent thereto. Thus, with the post 380 inserted through the axial lining 394, the pad 46 is in its releasably secured state to the post 380. In the releasably secured state, the lower end 400 extends beyond the axial lining 396 such that the ball 402 no longer is engaged by the axial lining 396. Accordingly, the predetermined force applied to the curved surface portion 406 is removed therefrom so as to allow the detent ball 402 to rebound under the influence of the plastic backing 404 to its extended position beyond the radius of the post 380. The ball 402 is mounted on the post 380 at a predetermined distance from the bottom 408 of the elevated mounting portion 382 and the length of the axial sleeve 394 is also predetermined so that with the pad 46 is releasably secured to the post 408 and the ball 402 in its extended position, the upper curved surface portion 412 will abut against the lower annular end or shoulder 414 of the axial sleeve so that there is no loose space or play between the raised post-receiving member 390 and the counterweight assembly 308.

With the pad 46 mounted to the quick-change pad mounting post 380 having the detent ball 402 thereon and when an operator wants to change pads to go to a different type of pad or because the pad 46 needs replacing due to wear or damage or the like, the pad 46 can quickly and easily be removed from its mounting to the apparatus 10 without requiring substantial time or disassembly which would otherwise complicate the pad changing process. To remove the pad 46, an operator need merely exert a downward force away from the pad mounting post 380 on the pad mounting plate 388 sufficient to cause the lining annular bottom shoulder 414 to cam over the upper curved surface portion 412 so as to urge the ball 402 to its depressed position flush with the post surface against the normal bias of the plastic backing 404. With the ball 402 in its depressed position, continued downward force on the pad mounting plate 388 causes the lining 396 to slide off of the post 380 until the pad mounting plate 388 and the attached pad 46 are disengaged from the post 380.

Although the ball 402 and pad mounting post 380 provide a secure mounting of the pad 46 to the apparatus 10, it is possible that during use of the apparatus 10, a force sufficient to cause the detent ball 402 to move to its depressed position could be applied to the pad 46 and/or pad mounting plate 388. In the event of such an occurrence, the axial lining 396 is provided with an intermediate circumferential groove 416 spaced above the detent ball 402 to prevent the post 380 from sliding completely through the axial sleeve 394 to the disengaged position.

The circumferential groove 416 has a predetermined radius sized so as to be capable of capturing the detent ball 402 in an extended position where it protrudes beyond the surface of the post 380 as it passes thereover. Thus, with the pad 46 mounted to the post 380 and with an unexpected force applied to the pad mounting plate 388 or the attached pad 46 causing the ball 402 to move to its depressed position within the axial lining 396, continued movement of the post 380 through the axial lining 396 will eventually cause the ball 402 to encounter the groove 416. The urging of the plastic backing 404 will push the ball 402 into an extended position in the circumferential groove 416 and thus arrest continued movement of the post 380 through the sleeve 394 so as to provide substantially fail-safe operation of the apparatus 10 when the pad 46 is secured on the pad mounting post 380.

Figure 23:
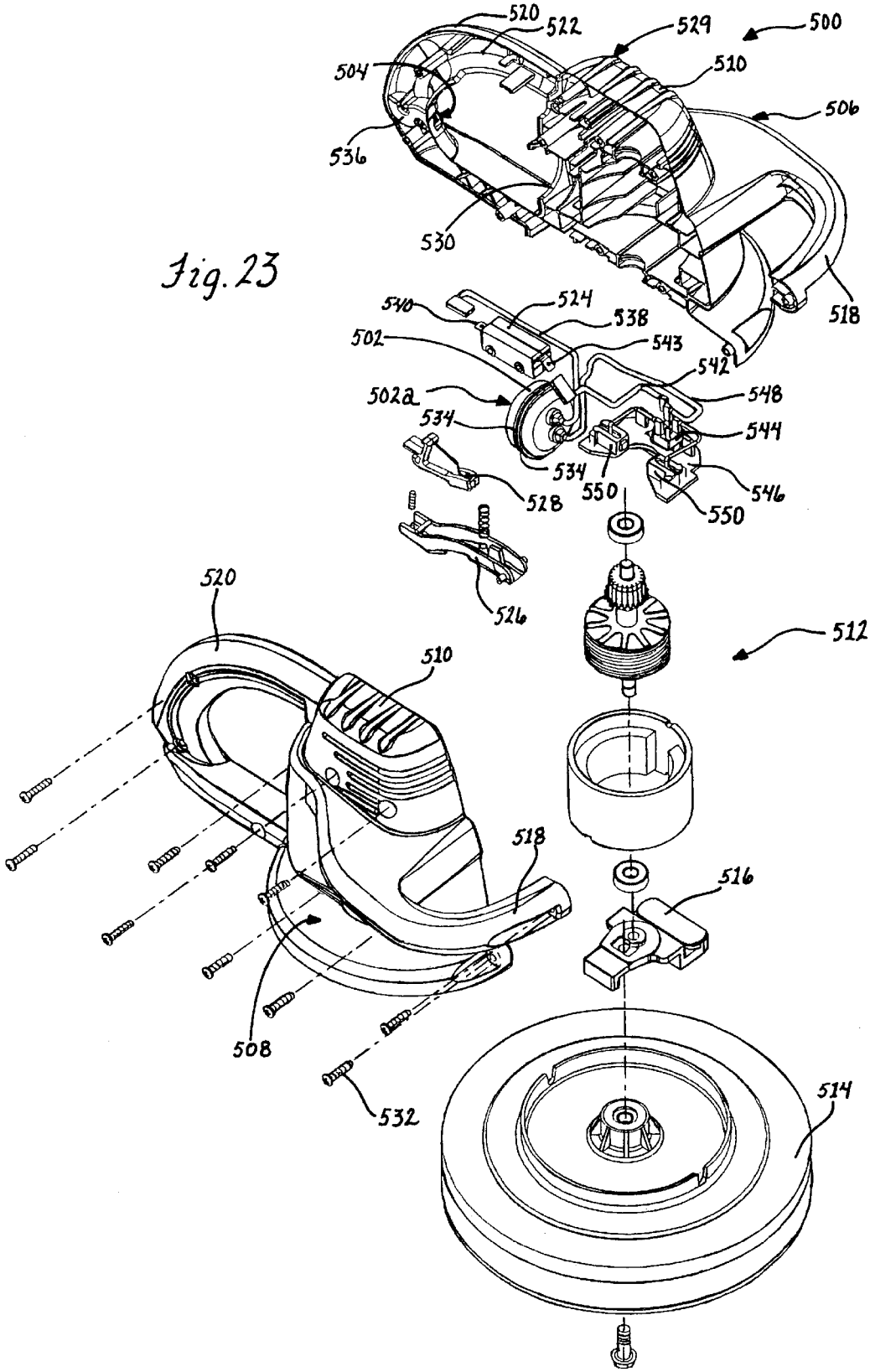
FIG. 23 is an exploded perspective view of an alternative apparatus for waxing, buffing, polishing or the like in accordance with the present invention.

FIG. 23 illustrates an alternative apparatus 500 for waxing, buffing or the like, in accordance with the present invention. The alternative apparatus 500 is substantially identical to the previously described apparatus 10, with the primary differences being related to an alternative location for both a male receptacle or power plug 502 for the power supply cord 558 and an alternative power cord locking mechanism 504.

More specifically, as with the previous apparatus 10 of FIGS. 1–22, the alternative apparatus 500 also has a clamshell design made up primarily from a first housing member 506 connected along a parting line with a second housing member 508. The first and second housing members 506 and 508 form a main central housing 510 in which a motor assembly 512 is mounted about a central axis to operate a buffer pad 514 in an orbital path through a counterweight 516 below the housing 506. A front handle 518 extends from the main housing 510 in a plane generally perpendicular to the axis of rotation of the motor assembly 512, and a rear handle 520 extends from the main housing 510 in a plane generally perpendicular to the plane of the front handle 518. The rear handle 520 has gripping portion 521 that extends from adjacent top 529 of the housing 510 rearwardly away therefrom and vertically downward in an arcuate manner to a distal end 523 in which cord lock mechanism 504 is formed. The rear handle 520 has a hollow interior 522 in which is mounted a box-shaped switch 524 to selectively energize the motor assembly 512. An operator actuates the switch 524 through a spring biased actuator paddle 526 that also includes a lock trigger 528 to maintain the paddle 526 in the actuated state. The structure, assembly and function of the above-mentioned components are substantially identical to those for the previously described apparatus 10.

Referring to FIGS. 23–25, a primary modification in the alternative apparatus 500 is the location towards the bottom and at the rear of the main central housing 510 of the male receptacle or plug plate 502 for receiving the female socket 560 of the power supply cord 558. The receptacle 502 mounts at the rear of the housing 510 so that its opening 502*a* faces toward the rear handle 520. This modified location of the receptacle 502 enables the operator to turn the apparatus 500 over and rest it on a top portion 529 of the main housing 510 to easily change a bonnet 527 fitted over the pad 514 without having to disconnect the power supply cord 558. The various bonnets include those for wax application, for polishing and buffing, which can be made from terrycloth, and for high grade buffing, which can be made from lamb's wool.

In cooperation with the rearward facing receptacle 502, the cord lock mechanism 504 is formed in the distal end portion 523 of the rear handle 520 behind the main housing 510 in general horizontal alignment with the receptacle 502 such that a line 561 from the receptacle 502 to the cord lock 504 is perpendicular to the housing central axis. The cord lock mechanism 504 prevents unintentional and accidental disconnection of the female plug 560 from the receptacle 502 during operation of the waxer apparatus 500 and changing between different bonnets. The cord lock mechanism 504 captures and maintains the power cord 558 in a manner that prevents interference with the operators ability to grip the rear handle 520 anywhere therealong for enhanced control of the waxer apparatus 500.

Referring to FIG. 23, the first and second housing members 506 and 508 each include an arcuate edge 530 at the rear of the main housing 510 which cooperate to mount the receptacle 502 with its opening 502*a* facing the rear handle 520. These edges 530 cooperate to define a recess for the receptacle 502 when the members 506 and 508 are assembled and held together by a number of screws 532. The perimeter of the recess substantially matches the outer perimeter of the receptacle 502 such that the edges 530 engage and hold the receptacle 502 in place when the housing members 506 and 508 are tightened together by the screws 532. The edges 530 engage the receptacle 502 between flanges 534 extending radially from the perimeter of the receptacle 502 so that the receptacle 502 is fixed in place relative to the housing 510 so that the power cord 558 can be connected thereto and disconnected therefrom.

The receptacle 502 supplies power to the motor assembly 512 via a first lead line 538 that interconnects the receptacle 502 to the switch input terminal 540. A second lead line 542 interconnects the switch output terminal 543 to a rectifier 544 mounted on a plug plate 546. A third lead line 548 interconnects the receptacle 502 directly to the rectifier 544. A pair of brushes 550 mounted on the plug plate 546 supply power to energize the motor assembly 512 when the switch 524 is activated by the operator through the actuator paddle 526.

As mentioned above, the cord lock mechanism 504 is located in the rear handle 520 directly behind and in general alignment with the receptacle 502. The cord lock mechanism 502 is formed in the rear handle portion of the first housing member 506 and defines an arcuate or curved recess 551 extending towards the hollow interior 522 of the rear handle 520, as defined in part by a bottom wall 536.

Referring to FIG. 24, the curved recess 551 is further defined by a top and bottom side wall 553 and 555, respectively, to have an entry portion 552, an opposite, exit portion 554 and a downward curved portion 556 therebetween. A power cord 558, having its female plug head 560 connected to the receptacle 502, includes a section portion 562 thereof that is pressed into the curved recess 551. This cord portion 562 is engaged in the curved recess 551 against the bottom and side walls 536, 553 and 555 with a friction fit sufficient to prevent undesired tension from being transmitted to the portion of the cord between the lock mechanism 504 and the receptacle 502, and thus to the interface between the cord plug head 560 and the receptacle 502.

The cord lock mechanism 504 maintains the power supply cord 558 attached to the waxer apparatus 500 from interfering with the operator's ability to grip the rear handle 520 at various locations therealong above the distal end 523 thereof. Further, the curved recess 551 has sufficient depth to receive the cord portion 562 so that it is seated therein substantially flush with the rear handle 520. In addition, the cord lock mechanism maintains the section 564 of the cord 558 between the receptacle 502 and the cord lock mechanism 504 substantially adjacent to and parallel to a bottom joining portion 564 of the rear handle 520 keeping gripping aperture 520*a* unimpeded by the cord section 564 for gripping of the arcuate handle portion 521, thereby assisting in eliminating cord interference with the operator's grip.

Figure 26:
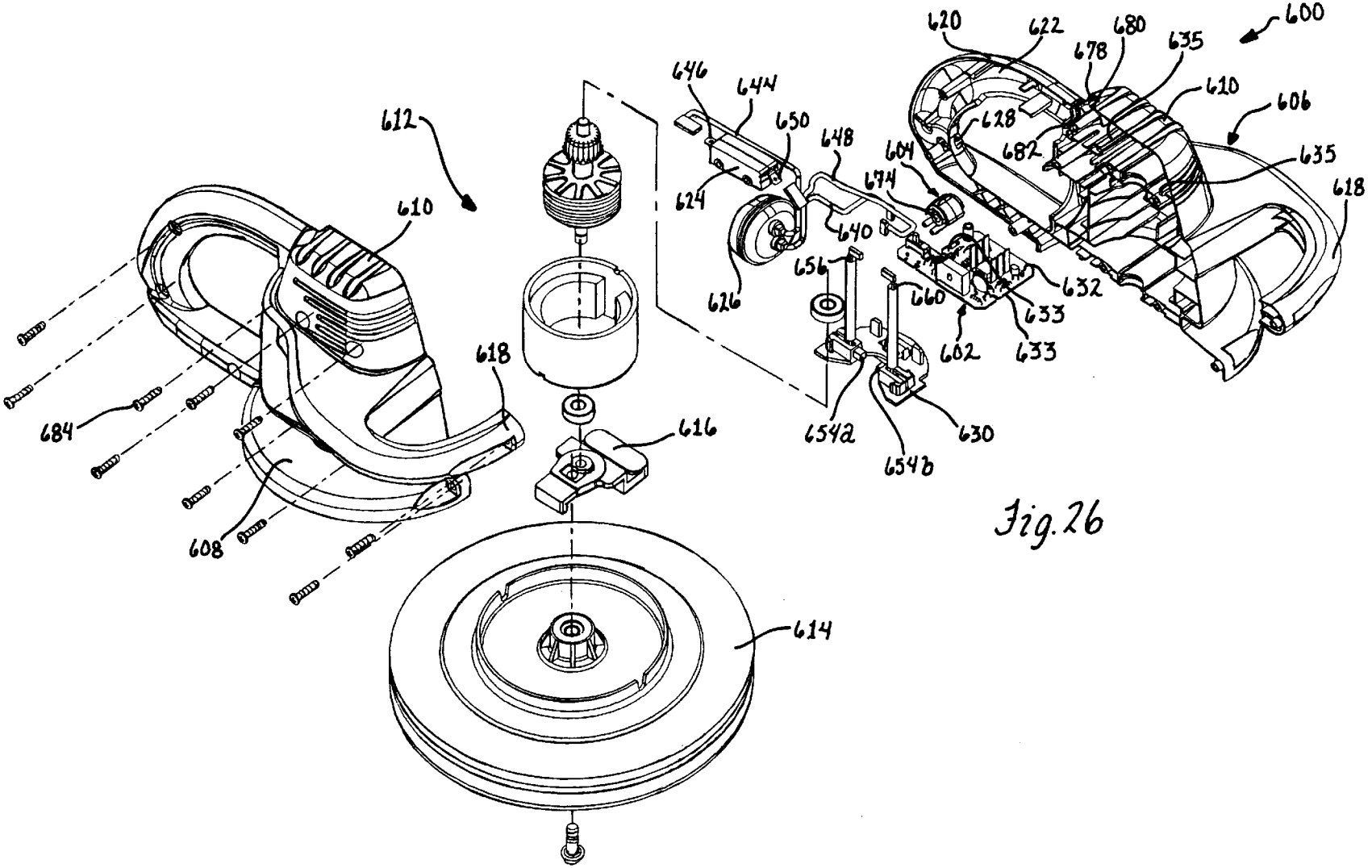
FIG. 26 is an exploded perspective view of a second alternative apparatus for waxing, buffing, polishing or the like in accordance with the present invention.
Figure 29:
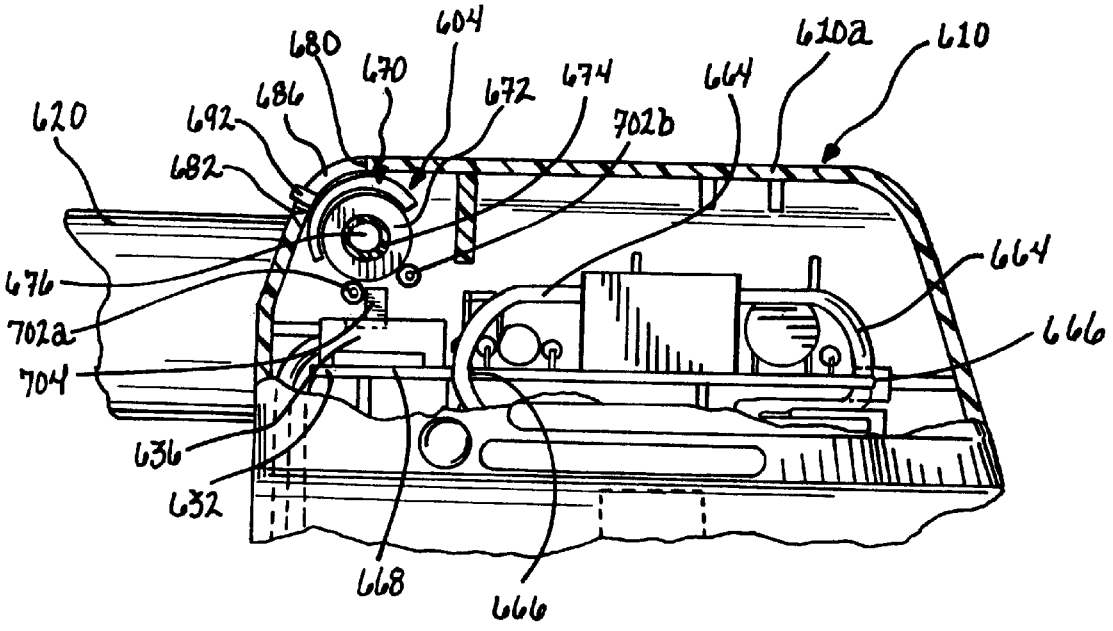
FIG. 29 enlarged elevational view partially in section of the alternative apparatus of FIG. 26 showing the rotary actuator operation on the linear switch for changing between various outputs.

FIG. 26 illustrates a second alternative apparatus 600 for waxing, buffing or the like, in accordance with the present invention. The alternative apparatus 600 is substantially identical to the previously described apparatus 500, with the primary modifications being related to the addition of a power control board 602 and an actuator 604 to enable the operator to select between various output torques at different stages of the polishing process.

More particularly, as with the previous apparatus 10 of FIGS. 1–22 and the alternative apparatus 500 of FIGS. 23–26, this second alternative apparatus 600 also has a clamshell design consisting primarily of a first housing member 606 that connects along a parting line with a second housing member 608. The first and second housing members 606 and 608 form a main central housing 610 in which a motor assembly 612 is mounted about a central axis to operate a pad 614 in an orbital path below the central housing 610 via a counterweight 616. A front handle 618 extends from the main housing 610 in a plane generally perpendicular to the axis of rotation of the motor assembly 612, and a rear handle 620 extends from the main housing 610 in a plane generally perpendicular to the plane of the front handle 618 in a manner identical to the previously-described handles for the apparatuses 10 and 500. The rear handle 620 has a hollow interior 622 in which is mounted a box-shaped switch 624 to selectively energize the motor assembly 612.

Similar to the alternative apparatus 500, this alternative apparatus 600 includes a male receptacle or plug plate 626 mounted in the rear of the main housing 610 with its opening facing toward the rear handle 620. The structure, function and assembly of the receptacle 626 is identical to that of the receptacle 502 of the previous alternative apparatus 500. Also, this alternative apparatus 600 includes a cord locking mechanism 628 in the rear handle 620 having the same structure and function of the cord lock mechanism 504 of the previous alternative apparatus 500.

As discussed, the second alternative apparatus 600 is provided with the power control board 602 to selectively change the operating speed of the motor assembly 612 between a low torque output for the pad 614 and a high torque output for the pad 614. To reduce the likelihood of damage to the working surface, such as the exterior finish of an automobile, and to increase efficiency, the low torque output is preferred for applying the wax to the automobile and the high torque output is preferred for removing the dry wax to a shine and to increase the luster of the finish. The preferred low torque is generated from motor speeds in the approximate range of 2700–2800 rpm and the high torque is generated from motor speeds in the approximate range of 2800–2900 rpm. While the difference between the high and low settings is only about 100–200 rpm, it has been found that the difference in torque outputs is significant in terms of how much power, and thus friction, that are generated at the interface between the pad assembly 614 and work surface so that the control over the power output has been found to provide significant performance advantages for the waxer apparatus 600 herein. While the apparatus disclosed herein includes only two settings, any number of additional speeds and corresponding torque outputs would be in accordance with the present invention, such as an intermediate speed for an intermediate torque output.

The power control board 602 is mounted in the first housing member 606 directly above a brush card 630 used to supply power directly to the motor assembly 612. The power control board 602 includes a plastic printed circuit board 632 with a pair of side edges 633 that are slidably received with a slight friction fit in a pair of complementary grooves 635 located in the central housing 610. The grooves 635 open toward one another and extend so that the board 632 is generally in a plane perpendicular to the general axis of rotation of the motor assembly 612. A portion of the board 632 extends beyond the grooves 635 over the brush card 630.

Referring to FIG. 28, the printed circuit board 632 of the power control board 602 has electrically connected thereto on its top side a rectifier 634, a linear speed control switch 636 and other electronic circuitry 638 thereabout. The circuitry 638 is designed to provide the desired power output differences for the low torque output and high torque output for the apparatus 600. The power control board 632 enables the use of a lower cost rectifier by not requiring a rectifier outfitted with elongate blade terminals that require special accommodations for lead line attachments exterior of the rectifier and for connecting to the circuitry inside the rectifier. Instead, the rectifier includes a more economical design in that lead pins (not shown) that are part of the rectifier internal circuitry are simply routed to extend a short distance out from the body 634*a* of the rectifier for being electrically plugged into the printed circuit board. The bottom side of the power control board 632 includes a printed circuit pattern etched thereon for connecting the above components.

Referring to FIGS. 26–28, a first lead line 640 interconnects the receptacle 626 to a first terminal 642 on the board 632. A second lead line 644 interconnects the receptacle 626 to an input terminal 646 of the switch 624, and a third lead line 648 interconnects an output terminal 650 of the switch 624 to a second terminal 652 on the board 632.

The brush card 630 includes a positive and negative brush 654*a* and 654*b*, respectively, for supplying power to the motor assembly 612. A fourth lead line 656 interconnects the positive brush 654*a* to a fourth terminal 658 on the board 632, and a fifth lead line 660 interconnects the negative brush 654*b* to a fifth terminal 662 on the board 632.

The fourth and fifth lead lines 656 and 660 for the brushes 654 are surrounded by shrink tubing 664 to provide protection and stiffening to the lead lines 656 and 660. The board 632 includes slots 666 at its perimeter adjacent both of the fourth and fifth terminals 658 and 662, respectively, for receiving and engaging the shrink tubes 664 to assist in preventing unintentional disconnection and to support the board 632 against vibrations.

The actuator 604 is mounted to the main housing 610 at a location directly over the linear speed control switch 636 mounted on the power control board 632. In this regard, a portion 668 of the board 632 carrying the linear switch 636 extends rearward underneath the actuator 604.

The actuator 604 includes an arcuate outer member 670 affixed to a central bearing hub 672 which in turn defines a hollow tubular passage 674. The tubular passage 674 mounts the actuator 604 on a bearing support shaft 676 that defines an axis of rotation extending substantially perpendicular to the housing central axis and the plane of the rear handle 620. The bearing shaft 676 extends into the main housing 610 to locate the actuator 604 on the main housing 610 above the juncture of the rear handle 620 with the upper portion of the main housing 610. This location provides the operator with convenient access to the actuator such as when gripping handle 620 near the top thereof to shift the apparatus between different torque outputs.

The first and second housing members 606 and 608 each include an arcuate side edge 678 and front and rear edges 680 and 682, respectively. When the first and second housing members 606 and 608 are assembled and held together with a number of screws 684, the edges 678, 680 and 682 define an arcuate opening 686 in the main housing 610 for the actuator 604 above the juncture of the handle 620 with the upper portion of the main housing 610.

The outer member 670 of the actuator includes a central arcuate portion 688 that extends across the opening 686 and that has an exterior surface 690 with a contour generally complementing the exterior of the housing 610 surrounding the opening 686. A rib 692 projects across the center area from the exterior surface 690 of the arcuate portion 688 for being engaged by the operator to easily operate the actuator 604 such as by their thumb on the hand wrapped about the handle 620. The rib 692 extends generally parallel to the axis of rotation for the actuator 604.

The outer member 670 includes an arcuate flange 694 along each side of the central arcuate portion 688 and a substantially linear transverse flange 696 along the ends of central arcuate portion 688. The flanges 694 and 696 are separated from the central arcuate portion 688 by a step 698. The step 698 along the side edges may be adapted to engage the arcuate side edges 678 defining the opening 686 to limit lateral shifting of the actuator 604 along the bearing shaft 676. The arcuate flanges 694 include an upper surface that engages the inner side of the main housing 610 to further guide the rotational operation of the actuator 604.

The actuator 604 includes a pair of tubular arms 702*a* and 702*b* extending substantially parallel from the bearing hub 672. The arms 702 form a yoke about a linear actuator projection 704 for the linear switch 636 located on the control board 602. The arms 702 are sufficiently spaced so that, when the actuator 604 is rotated rearward toward the handle 620, the rear arm 702*a* slides against and pushes the projection 704 forward to a first low torque output for wax application, and, when the actuator 604 is rotated in the opposite, forward direction, the front arm 702*b* slides against and pushes the projection 704 rearward to a second high torque output for polishing and buffing. The angular separation between the arms 702, the angular location of the arms 702 relative the outer member 670, and the size of the housing opening 686 are predetermined based on the required linear travel of the projection on the linear switch to set the different speeds.

In operation, the waxer apparatus 600 is first turned over and rested on top 610*a* of the housing 610 on a support surface 611 and the pad 614 is fitted with a bonnet for wax application. After applying wax to the bonnet, the waxer apparatus 600 is gripped by its handles and the actuator 604 is set to the application speed for low torque output to the pad 614 by the operator while gripping the rear handle 620. After wax application to the working surface, the waxer apparatus 600 is again turned over on its housing 610, and the wax application bonnet is replaced with a different bonnet for buffing and polishing the working surface. The waxer apparatus 600 is then returned to its operating orientation, and the actuator 604 is rotated to set the waxer apparatus 600 to the buffing and polishing speed for high torque output to the pad 614 by the operator while gripping the rear handle 620.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

What is claimed is:

1. A power waxer having a pad driven by an electric motor, the power waxer comprising:

a housing containing the motor and having an upper portion and a lower portion with the pad being mounted below the lower portion to be driven by the motor and engaged against a surface on which wax is to be applied and polished;

a handle extending away from the upper portion of the housing generally in a vertical plane;

a rotary switch actuator adjacent the junction of the housing upper portion and the handle and including a curved exterior portion for being rotated by a hand of an operator that is gripping the handle with the exterior portion being curved about a transverse axis that is perpendicular to the vertical plane; and a linear switch in the housing for linear sliding to a plurality of positions corresponding to different output speeds for the motor including a first wax applying position at which the motor drives the pad in a wax applying mode and a second wax polishing position at which the motor drives the pad in a wax polishing mode with the output speeds of the motor being lower in the wax applying mode over the motor output speeds in the wax polishing mode to allow the operator to exercise greater control over the waxer for applying wax to ensure there is complete coverage on the surface to be waxed the switch being connected to the rotary actuator so that rotation of the actuator curved portion about the axis causes linear sliding of the switch for changing the modes and output speeds of the motor.

2. The power waxer of claim 1 wherein the housing includes a bearing supporting the curved portion of the actuator for rotation thereabout, the rotary actuator includes a pair of spaced members in the housing that are rotated along the bearing as the actuator is rotated, and the switch includes a projection between the actuator spaced members for being slid linearly thereby when the actuator is rotated.

3. The power waxer of claim 2 wherein the switch projection slides forwardly and rearwardly and the actuator curved portion is rotatable in forward and rearward rotation directions such that when the actuator is rotated in the forward direction, one of the spaced members pushes the projection to slide rearwardly, and when the actuator is rotated in the rearward direction, the other of the spaced members pushes the projection to slide forwardly.

4. The power waxer of claim 1 wherein the motor drives the pad in an orbital path and the housing includes a front and a rear with the handle being at the rear of the housing, and a second handle having a portion spaced forwardly of the housing front and generally extending arcuately in a horizontal plane to provide for two-handed control over the waxer with the operator gripping along both handles at various positions thereon while operating the waxer for maximizing control thereover.

5. A power waxer having a pad driven by an electric motor, the power waxer comprising:

a housing containing the motor and having an upper portion and a lower portion with the pad being mounted below the lower portion to be driven by the motor;

a handle extending away from the upper portion of the housing generally in a vertical plane;

a rotary switch actuator adjacent the junction of the housing upper portion and the handle and including a curved exterior portion for being rotated by a hand of an operator that is gripping the handle with the exterior portion being curved about a transverse axis that is perpendicular to the vertical plane; and a linear switch in the housing for linear sliding to a plurality of positions so that when the switch is slid from one position to another position, the motor correspondingly changes from generating one torque output to another torque output, the switch being connected to the rotary actuator so that rotation of the actuator curved portion about the axis causes linear sliding of the switch for changing torque outputs of the motor;

wherein the handle includes a distal end spaced from the housing that is at a level generally aligned with the housing lower portion, and a motor actuator for selectively energizing the motor with the motor actuator spaced from the handle distal end for being engaged by a hand of an operator that is gripping the handle to control the waxer.

6. The power waxer of claim 5 wherein the handle has an arcuate portion to which the motor actuator is mounted, and the motor actuator is a paddle actuator having an arcuate shape substantially complementary to that of the handle arcuate portion.

7. The power waxer of claim 5 wherein the motor actuator includes a lock-on mechanism for keeping the motor actuator in a position at which the motor is constantly energized without requiring that an operator continually engage the motor actuator to hold the actuator in said motor energizing position.

8. The power waxer of claim 5 wherein the housing includes a receptacle for receiving a plug on an end of a power cord attached therein, the receptacle having an opening facing the handle distal end, and the handle distal end includes a cord lock for capturing a section of power cord therein to limit accidental disconnections between the receptacle and plug attached therein.

9. The power waxer of claim 8 wherein the motor comprises a direct current motor assembly, the plug receptacle is for electrically connecting an alternating current power supply to the waxer, and a rectifier for converting the alternating current from the power supply to direct current for the motor assembly and having a body in which a plurality of lead pins are mounted and that extend exteriorly therefrom for being electrically connected to a printed circuit board.

10. In a power tool having a housing for containing a motor that drives a working element and a handle extending away from the housing for being gripped to control the tool, a motor output control mechanism comprising:

a linear switch mounted in the housing for being shifted in a linear direction to a plurality of predetermined positions for changing the torque output of the motor applied to the working element;

a rotary actuator mounted adjacent the handle and rotatable about an axis for shifting the linear switch between the predetermined positions thereof; and a connection between the switch and actuator for shifting the switch in the linear direction as the actuator is rotated about the axis to change torque outputs of the motor;

wherein the rotary actuator includes a curved exterior portion accessible to an operator on the housing for rotating the actuator, and a curved bearing in the housing on which the curved exterior portion of the actuator is mounted for rotation thereon.

11. The motor output control mechanism of claim 10 wherein the switch includes a switch projection for sliding linearly, and the rotary actuator includes spaced members below the curved exterior portion thereof for being disposed on either side of the projection in the housing and riding on the curved bearing as the actuator is rotated about the axis so that as the members move in a curved path defined by the curved bearing the projection is slid in the linear direction.

12. A power waxer having different modes of operation for different stages of a waxing operation on a work surface, the power waxer comprising:

a housing for containing a variable speed motor;

a pad driven by the motor at different speeds in the different operating modes;

circuitry in the housing for providing different torque outputs at different output speed ranges of the motor; and a mode selecting actuator connected to the circuitry to allow an operator to select a first wax applying mode with the motor generating a predetermined first output operating speed range to provide a first output torque to the pad, and a second wax polishing mode with the motor generating a predetermined second output operating speed range to provide a second output torque to the pad, the first output torque being lower than the second output torque to allow an operator to exercise greater control over the waxer during the wax applying mode and to generate greater friction between the pad and work surface during the wax polishing mode.

13. The power waxer of claim 12 including a second on/off actuator distinct from the mode selecting actuator for selectively activating and deactivating the motor.

14. The power waxer of claim 13 wherein the housing includes a handle and both the first and second actuators are mounted to the handle for easy access by a hand of the operator holding the handle.

* * * * *